US009520028B2

(12) United States Patent
Kitamura et al.

(10) Patent No.: US 9,520,028 B2
(45) Date of Patent: Dec. 13, 2016

(54) GAMING MACHINE THAT PROGRESSES THE GAMES FROM BASE GAMES TO FEATURE GAMES

(71) Applicants: Universal Entertainment Corporation, Tokyo (JP); Aruze Gaming America, Inc., Las Vegas, NV (US)

(72) Inventors: Kenta Kitamura, Tokyo (JP); Kensaku Yoshikawa, Tokyo (JP); Tatsuya Teranishi, Tokyo (JP)

(73) Assignees: UNIVERSAL ENTERTAINMENT CORPORATION, Tokyo (JP); ARUZE GAMING AMERICA, INC., LAS VEGAS, NV (US)

( * ) Notice: Subject to any disclaimer, the term of this patent is extended or adjusted under 35 U.S.C. 154(b) by 239 days.

(21) Appl. No.: 14/313,068

(22) Filed: Jun. 24, 2014

(65) Prior Publication Data

US 2015/0024824 A1 Jan. 22, 2015

(30) Foreign Application Priority Data

Jul. 17, 2013 (JP) ..... 2013-148941

(51) Int. Cl.
*G07F 17/32* (2006.01)

(52) U.S. Cl.
CPC ..... *G07F 17/3258* (2013.01); *G07F 17/329* (2013.01); *G07F 17/3267* (2013.01)

(58) Field of Classification Search
CPC . G07F 17/3258; G07F 17/329; G07F 17/3267
See application file for complete search history.

(56) References Cited

U.S. PATENT DOCUMENTS

| | | | | |
|---|---|---|---|---|
| 7,942,733 | B2 | 5/2011 | Sakuma | |
| 2002/0096827 | A1* | 7/2002 | Markowiak | A63F 3/00157 273/138.1 |
| 2003/0222402 | A1* | 12/2003 | Olive | G07F 17/32 273/292 |
| 2007/0060369 | A1* | 3/2007 | Martin | G07F 17/3276 463/42 |
| 2009/0026703 | A1* | 1/2009 | Brennan | A63F 1/04 273/269 |
| 2012/0115569 | A1* | 5/2012 | Fujisawa | G07F 17/34 463/20 |
| 2012/0309487 | A1* | 12/2012 | Yoshikawa | G07F 17/3267 463/20 |

* cited by examiner

*Primary Examiner* — James S McClellan
*Assistant Examiner* — Kevin Carter
(74) *Attorney, Agent, or Firm* — Lex IP Meister, PLLC

(57) ABSTRACT

Provided is a gaming machine that can entertain a player by developing various game results after entering a feature game mode from a base game mode. The gaming machine progresses the games as follows: in base games, if trigger symbols appearing at rearrangement of symbols complete a specific arrangement pattern, the games are changed from base games into roulette games. In roulette games, the maximum number of lotteries is determined based on the arrangement pattern of the trigger symbols.

8 Claims, 28 Drawing Sheets

FIG. 8

PAYLINE DEFINITION TABLE

| No. | FIRST REEL | SECOND REEL | THIRD REEL | FOURTH REEL | FIFTH REEL |
|---|---|---|---|---|---|
| 1 | 1 | 1 | 1 | 1 | 1 |
| 2 | 0 | 0 | 0 | 0 | 0 |
| 3 | 2 | 2 | 2 | 2 | 2 |
| 4 | 0 | 1 | 2 | 1 | 0 |
| 5 | 2 | 1 | 0 | 1 | 2 |
| 6 | 0 | 2 | 0 | 2 | 0 |
| 7 | 2 | 0 | 2 | 0 | 2 |
| 8 | 1 | 0 | 1 | 0 | 1 |
| 9 | 1 | 2 | 1 | 2 | 1 |
| 10 | 0 | 0 | 1 | 0 | 0 |
| 11 | 2 | 2 | 1 | 2 | 2 |
| 12 | 1 | 0 | 2 | 0 | 1 |
| 13 | 1 | 2 | 0 | 2 | 1 |
| 14 | 0 | 2 | 2 | 2 | 0 |
| 15 | 2 | 0 | 0 | 0 | 2 |
| 16 | 0 | 1 | 0 | 1 | 0 |
| 17 | 2 | 1 | 2 | 1 | 2 |
| 18 | 1 | 1 | 0 | 1 | 1 |
| 19 | 1 | 1 | 2 | 1 | 1 |
| 20 | 1 | 0 | 0 | 0 | 1 |
| 21 | 1 | 2 | 2 | 2 | 1 |
| 22 | 0 | 1 | 1 | 1 | 0 |
| 23 | 2 | 1 | 1 | 1 | 2 |
| 24 | 0 | 0 | 2 | 0 | 0 |
| 25 | 2 | 2 | 0 | 2 | 2 |
| 26 | 0 | 0 | 1 | 2 | 2 |
| 27 | 2 | 2 | 1 | 0 | 0 |
| 28 | 1 | 2 | 1 | 0 | 1 |
| 29 | 2 | 0 | 1 | 0 | 2 |
| 30 | 0 | 2 | 1 | 2 | 0 |

FIG. 9

SYMBOL CODE DETERMINATION TABLE

| | FIRST REEL | | SECOND REEL | | THIRD REEL | | FOURTH REEL | | FIFTH REEL | |
|---|---|---|---|---|---|---|---|---|---|---|
| CODE No. | SYMBOL | WEIGHT | SYMBOL | WEIGHT | SYMBOL | WEIGHT | SYMBOL | WEIGHT | SYMBOL | WEIGHT |
| 00 | BONUS | 4 | BONUS | 6 | BONUS | 3 | BONUS | 3 | BONUS | 5 |
| 01 | BLANK | 4 | BLANK | 5 | BLANK | 3 | BLANK | 3 | BLANK | 5 |
| 02 | BONUS | 4 | BONUS | 6 | BONUS | 3 | BONUS | 3 | BONUS | 5 |
| 03 | BLANK | 4 | BLANK | 7 | BLANK | 3 | BLANK | 3 | BLANK | 5 |
| 04 | 2BAR | 2 | 3BAR | 6 | 2BAR | 4 | 3BAR | 4 | 1BAR | 1 |
| 05 | BLANK | 3 | BLANK | 8 | BLANK | 4 | BLANK | 4 | BLANK | 1 |
| 06 | 1BAR | 3 | 1BAR | 7 | 1BAR | 4 | 2BAR | 3 | 3BAR | 3 |
| 07 | BLANK | 3 | BLANK | 3 | BLANK | 4 | BLANK | 3 | BLANK | 3 |
| 08 | RED7 | 4 | DOUBLE | 3 | RED7 | 4 | DOUBLE | 3 | RED7 | 3 |
| 09 | BLANK | 5 | BLANK | 3 | BLANK | 4 | BLANK | 3 | BLANK | 3 |
| 10 | BLUE7 | 4 | BLUE7 | 6 | BLUE7 | 4 | BLUE7 | 3 | BLUE7 | 3 |
| 11 | BLANK | 3 | BLANK | 7 | BLANK | 4 | BLANK | 3 | BLANK | 3 |
| 12 | 3BAR | 3 | 2BAR | 6 | 3BAR | 4 | 1BAR | 3 | 2BAR | 3 |
| 13 | BLANK | 3 | BLANK | 9 | BLANK | 4 | BLANK | 3 | BLANK | 3 |
| 14 | BLUE 7 | 5 | RED7 | 11 | DOUBLE | 4 | RED7 | 3 | BLUE7 | 3 |
| 15 | BLANK | 6 | BLANK | 9 | BLANK | 4 | BLANK | 3 | BLANK | 3 |
| 16 | RED7 | 6 | BLUE7 | 10 | RED7 | 4 | BLUE7 | 3 | RED7 | 3 |
| 17 | BLANK | 2 | BLANK | 10 | BLANK | 4 | BLANK | 3 | BLANK | 3 |
| 18 | 1BAR | 3 | 1BAR | 4 | 1BAR | 4 | 2BAR | 4 | 3BAR | 1 |
| 19 | BLANK | 3 | BLANK | 4 | BLANK | 4 | BLANK | 4 | BLANK | 1 |
| 20 | 2BAR | 3 | 3BAR | 8 | 2BAR | 3 | 3BAR | 3 | 1BAR | 5 |
| 21 | BLANK | 4 | BLANK | 6 | BLANK | 3 | BLANK | 3 | BLANK | 5 |
| TOTAL | | 81 | | 144 | | 82 | | 70 | | 70 |

FIG. 20

| NUMBER OF BONUS SYMBOLS | NUMBER OF LOTTERIES |
|---|---|
| 10 | 10 |
| 9 | 7 |
| 8 | 5 |
| 7 | 3 |
| 6 | 2 |
| 5 | 1 |

FIG. 22

| BET PER LINE | 1 | 2 | 3 | 4 | 5 | 10 | 15 | 20 |
|---|---|---|---|---|---|---|---|---|
| DIVIDEND | 2492 | 2464 | 2436 | 2408 | 2380 | 2240 | 2100 | 1960 |
| MINOR PROGRESSIVE JACKPOT | 27 | 54 | 81 | 108 | 135 | 270 | 405 | 540 |
| MAJOR PROGRESSIVE JACKPOT | 1 | 2 | 3 | 4 | 5 | 10 | 15 | 20 |
| DENOMINATOR | 2520 | 2520 | 2520 | 2520 | 2520 | 2520 | 2520 | 2520 |

FIG. 23

| BET PER LINE | 1 | 2 | 3 | 4 | 5 | 10 | 15 | 20 |
|---|---|---|---|---|---|---|---|---|
| DECREMENT OF WEIGHT FOR DIVIDEND | 178 | 176 | 174 | 172 | 170 | 160 | 150 | 140 |

FIG. 24

| BET PER LINE | | 1 | 2 | 3 | 4 | 5 | 10 | 15 | 20 |
|---|---|---|---|---|---|---|---|---|---|
| NUMBER OF SELECTED DIVIDENDS | 0 | 2492 | 2464 | 2436 | 2408 | 2380 | 2240 | 2100 | 1960 |
| | 1 | 2314 | 2288 | 2262 | 2236 | 2210 | 2080 | 1950 | 1820 |
| | 2 | 2136 | 2112 | 2088 | 2064 | 2040 | 1920 | 1800 | 1680 |
| | 3 | 1958 | 1936 | 1914 | 1892 | 1870 | 1760 | 1650 | 1540 |
| | 4 | 1780 | 1760 | 1740 | 1720 | 1700 | 1600 | 1500 | 1400 |
| | 5 | 1602 | 1584 | 1566 | 1548 | 1530 | 1440 | 1350 | 1260 |
| | 6 | 1424 | 1408 | 1392 | 1376 | 1360 | 1280 | 1200 | 1120 |
| | 7 | 1246 | 1232 | 1218 | 1204 | 1190 | 1120 | 1050 | 980 |
| | 8 | 1068 | 1056 | 1044 | 1032 | 1020 | 960 | 900 | 840 |
| | 9 | 890 | 880 | 870 | 860 | 850 | 800 | 750 | 700 |
| | 10 | 712 | 704 | 696 | 688 | 680 | 640 | 600 | 560 |
| | 11 | 534 | 528 | 522 | 516 | 510 | 480 | 450 | 420 |
| | 12 | 356 | 352 | 348 | 344 | 340 | 320 | 300 | 280 |
| | 13 | 178 | 176 | 174 | 172 | 170 | 160 | 150 | 140 |
| | 14 | 0 | 0 | 0 | 0 | 0 | 0 | 0 | 0 |

FIG. 25

| BET PER LINE | | 1 | 2 | 3 | 4 | 5 | 10 | 15 | 20 |
|---|---|---|---|---|---|---|---|---|---|
| NUMBER OF SELECTED DIVIDENDS | 0 | 2520 | 2520 | 2520 | 2520 | 2520 | 2520 | 2520 | 2520 |
| | 1 | 2342 | 2344 | 2346 | 2348 | 2350 | 2360 | 2370 | 2380 |
| | 2 | 2164 | 2168 | 2172 | 2176 | 2180 | 2200 | 2220 | 2240 |
| | 3 | 1986 | 1992 | 1998 | 2004 | 2010 | 2040 | 2070 | 2100 |
| | 4 | 1808 | 1816 | 1824 | 1832 | 1840 | 1880 | 1920 | 1960 |
| | 5 | 1630 | 1640 | 1650 | 1660 | 1670 | 1720 | 1770 | 1820 |
| | 6 | 1452 | 1464 | 1476 | 1488 | 1500 | 1560 | 1620 | 1680 |
| | 7 | 1274 | 1288 | 1302 | 1316 | 1330 | 1400 | 1470 | 1540 |
| | 8 | 1096 | 1112 | 1128 | 1144 | 1160 | 1240 | 1320 | 1400 |
| | 9 | 918 | 936 | 954 | 972 | 990 | 1080 | 1170 | 1260 |
| | 10 | 740 | 760 | 780 | 800 | 820 | 920 | 1020 | 1120 |
| | 11 | 562 | 584 | 606 | 628 | 650 | 760 | 870 | 980 |
| | 12 | 384 | 408 | 432 | 456 | 480 | 600 | 720 | 840 |
| | 13 | 206 | 232 | 258 | 284 | 310 | 440 | 570 | 700 |
| | 14 | 28 | 56 | 84 | 112 | 140 | 280 | 420 | 560 |

FIG. 26

| NUMBER OF SELECTED DIVIDENDS | 0 | 1 | 2 | 3 | 4 | 5 | 6 | ··· | 13 | 14 |
|---|---|---|---|---|---|---|---|---|---|---|
| DIVIDEND | 2492 | 2314 | 2136 | 1958 | 1780 | 1602 | 1424 | ··· | 178 | 0 |
| MINOR JACPOT | 27 | 27 | 27 | 27 | 27 | 27 | 27 | ··· | 27 | 27 |
| MAJOR JACPOT | 1 | 1 | 1 | 1 | 1 | 1 | 1 | ··· | 1 | 1 |
| DENOMINATOR | 2520 | 2342 | 2164 | 1986 | 1808 | 1630 | 1452 | ··· | 206 | 28 |

FIG. 27

| CELL No. | DIVIDEND | WEIGHT |
|---|---|---|
| 0 | MAJOR | 0 |
| 1 | 25 | 12 |
| 2 | 100 | 3 |
| 3 | 30 | 10 |
| 4 | 250 | 1 |
| 5 | 20 | 8 |
| 6 | 100 | 3 |
| 7 | 50 | 13 |
| 8 | MINOR | 0 |
| 9 | 25 | 13 |
| 10 | 100 | 2 |
| 11 | 15 | 13 |
| 12 | 500 | 1 |
| 13 | 20 | 8 |
| 14 | 150 | 1 |
| 15 | 15 | 12 |
| | DENOMINATOR | 100 |

FIG. 29

| | | |
|---|---|---|
| 15(15) | MAJOR JACKPOT(0) | 25(1) |
| 150(14) | | 100(2) |
| 20(13) | | 30(3) |
| 500(12) | | 250(4) |
| 15(11) | | 20(5) |
| 100(10) | | 100(6) |
| 25(9) | MINOR JACKPOT(8) | 50(7) |

7 Free GAMES

| |
|---|
| 10☆⇒7 |
| 9☆⇒5 |
| 8☆⇒4 |
| 7☆⇒3 |
| 6☆⇒2 |
| 5☆⇒1 |

GAMING MACHINE THAT PROGRESSES THE GAMES FROM BASE GAMES TO FEATURE GAMES

CROSS-REFERENCE TO RELATED APPLICATIONS

This application is based on and claims a priority from the prior Japanese Patent Application No. 2013-148941 filed on Jul. 17, 2013, the entire contents of which are incorporated herein by reference.

TECHNICAL FIELD

The present invention relates to a gaming machine and, in particular, relates to a gaming machine that rearranges symbols in each unit game and progresses the games by changing the games from base games to feature games such as free games.

BACKGROUND ART

Gaming machines are apparatuses which start a unit game in response to a player's operation of an operating component such as a set of buttons disposed on a control panel, scrolling symbols upon every start of a unit game to rearrange a part of the symbols in a display area. If a winning pattern is made in the display area after the rearrangement, the player gains a benefit (for example, refer to U.S. Pat. No. 7,942,733).

Considering diverse tastes of players, various gaming machines have been developed. For example, gaming machines different in symbol pattern, game scenario, presentation performances (by sound, image, or reel action) have been developed. Gaming machines that offer bonus games or free games under predetermined conditions have also been developed.

SUMMARY OF INVENTION

However, such a gaming machine repeats a unit game until a predetermined number of medals are paid out or a predetermined number of games are conducted after entering a bonus game mode of a feature game mode. Accordingly, in the bonus game mode, a player plays games until a predetermined number of medals or games are consumed. For this reason, feature games have not been games that develop the game results in various ways.

The present invention has been accomplished in view of the above-described problem and an object of the present invention is to provide a gaming machine that can entertain the player by developing various game results after entering the feature game mode from the base game mode.

An embodiment of a gaming machine of the present invention is:

a gaming machine configured to determine a dividend based on rearranged symbols, the gaming machine comprising:

a display having a display area in which symbols associated with a plurality of scroll lines are displayed; and a controller for controlling base games, roulette games, and free games, in which game results are displayed in the display area, the controller being programmed to perform the processing of (1-1) to (1-5):

(1-1) in the base games, switching the base games to the roulette games under a condition that a trigger related to a number of trigger symbols occurs;

(1-2) in the roulette games, determining a maximum number of lotteries based on the number of trigger symbols;

(1-3) determining a dividend in the free games or winning a jackpot by a lottery and switching the roulette games to the free games under a condition that a count of conducted lotteries reaches the maximum number of lotteries;

(1-4) in each of the roulette games, counting the conducted lottery in a case where the processing of (1-3) determines a dividend in the free games by the lottery; and (1-5) in each of the roulette games, repeating the processing of (1-3) without counting the conducted lottery in a case where the processing of (1-3) determines winning a jackpot by the lottery.

In the case of winning a jackpot, the gaming machine repeats a lottery in the roulette games without increasing the count of lotteries. Accordingly, in the case of winning a jackpot, the number of lotteries to be conducted is not consumed, maintaining a chance to increase the dividend. Furthermore, since the winning of a jackpot does not affect the determination of the dividend, the player can receive the benefit by the jackpot and the benefit by the dividend separately. The player can feel expectation about which is to be determined, a jackpot or a dividend, through common lotteries in the roulette games.

Furthermore, in the embodiment of the gaming machine of the present invention, the jackpot is one of a plurality of kinds of jackpots, and the controller is programmed to perform the processing of (2-1):

(2-1) in the roulette games, allowing all the plurality of kinds of jackpots to be won by lotteries.

Since there are a plurality of kinds of jackpot prizes, the player can feel expectation to win a jackpot. That is to say, for example, in the case where the existence of the plurality of kinds of jackpots is visualized on the display, the player can recognize that a plurality of kinds of jackpots exist. If the player knows the existence of the plurality of kinds of jackpots, the player can feel expectation to win at least one of the jackpots.

In addition, in the case of winning all the plurality of kinds of jackpots, the player can feel satisfaction of acquiring all and further, can get more benefit. If the plurality of kinds of jackpots include a jackpot to be easily won, the player can have a motivation to willingly accumulate his/her money to the jackpot so as to win the jackpot.

Still further, in the embodiment of the gaming machine of the present invention, the dividend in the free games is one of a plurality of kinds of dividends, and the controller is programmed to perform the processing of (3-1):

(3-1) in the roulette games, increasing a probability to win a jackpot depending on a number of kinds of dividends in the free games determined by lotteries.

With increase in number of kinds of dividends determined by lotteries in the roulette games, the probability to win a jackpot increases. Accordingly, as the number of kinds of dividends increases, the player can feel higher expectation to win a jackpot. Since the determination of dividend can affect the possibility of winning a jackpot, the roulette games can attain uniformity.

Advantageous Effects of Invention

Various game results developed after entering a feature game mode from a base game mode can entertain the player.

BRIEF DESCRIPTION OF DRAWINGS

FIG. 8 is a drawing illustrating an example of a payline definition table;

FIG. 9 is a drawing illustrating an example of a symbol code determination table;

FIG. 20 is a table defining association relations of the numbers of BONUS symbols and the numbers of lotteries;

FIG. 22 is a table illustrating a progressive determination initial table;

FIG. 23 is a table indicating decrements of weights defined for bet per line values;

FIG. 24 is a table indicating weights calculated through the processing of Step S2115;

FIG. 25 is a table indicating denominators calculated through the processing of Step S2117;

FIG. 26 is a table illustrating a progressive determination table created through the processing of Step S2119;

FIG. 27 is a table illustrating a dividend determination table defining association relations of cell numbers and the dividends and the weights for the cell numbers;

FIG. 29 is a drawing illustrating an example of a roulette image displayed on a video display unit 110.

DESCRIPTION OF EMBODIMENTS

Hereinafter, an embodiment is described based on the drawings.

Figure 1:
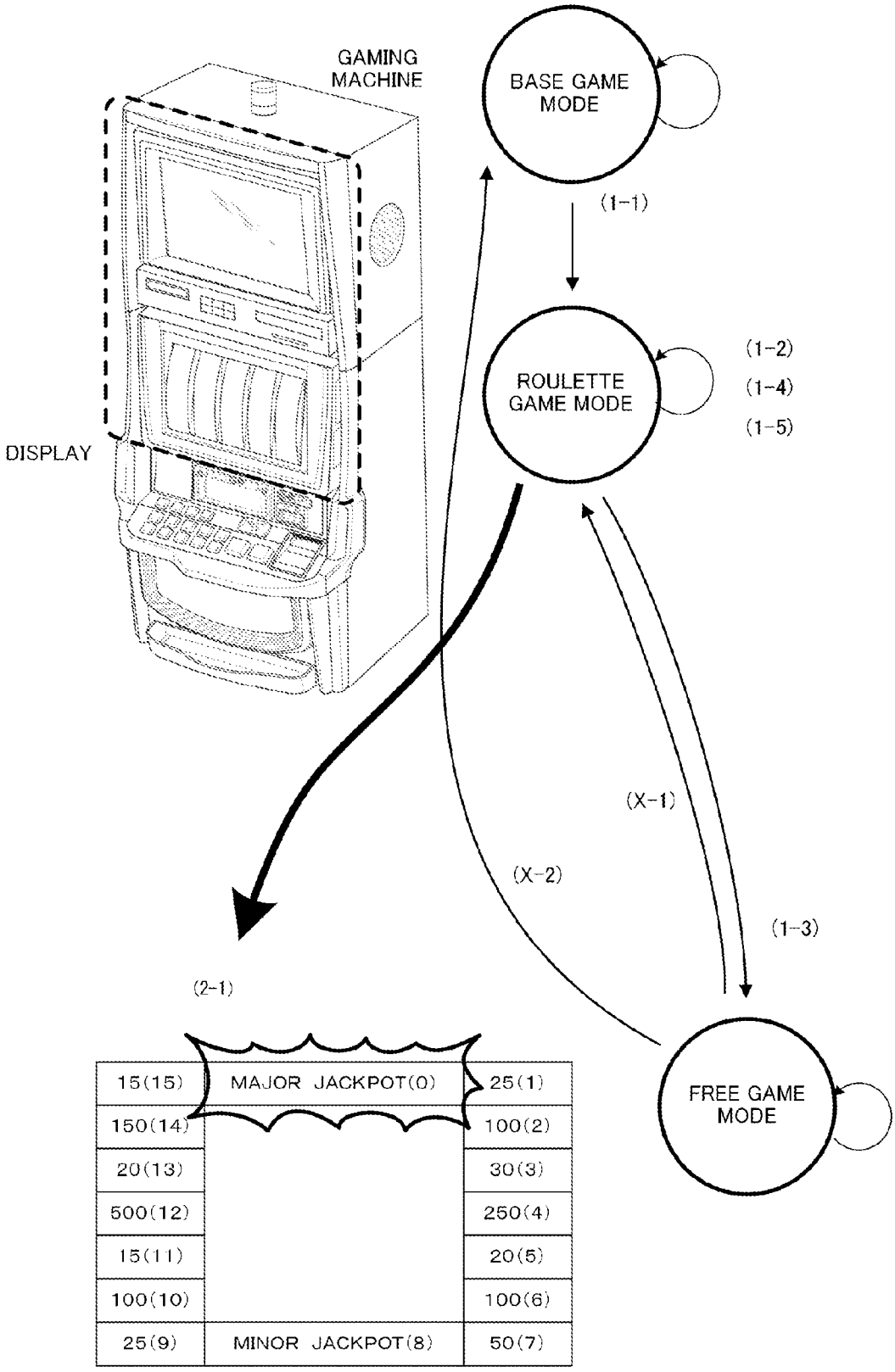
FIG. 1 is a drawing illustrating an overview of a gaming machine according to an embodiment.
Figure 17:
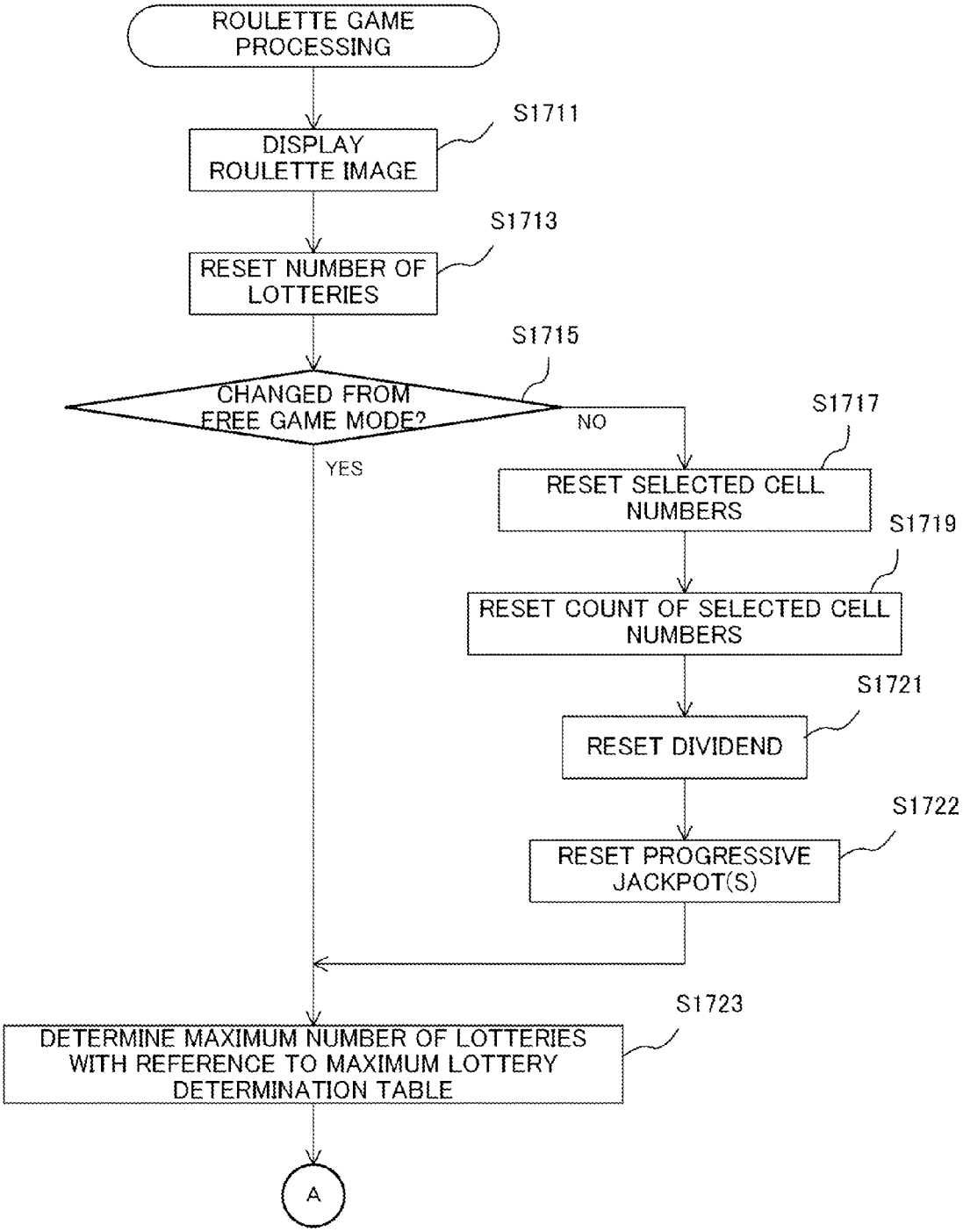
FIG. 17 is a flowchart of roulette game processing.
Figure 18:
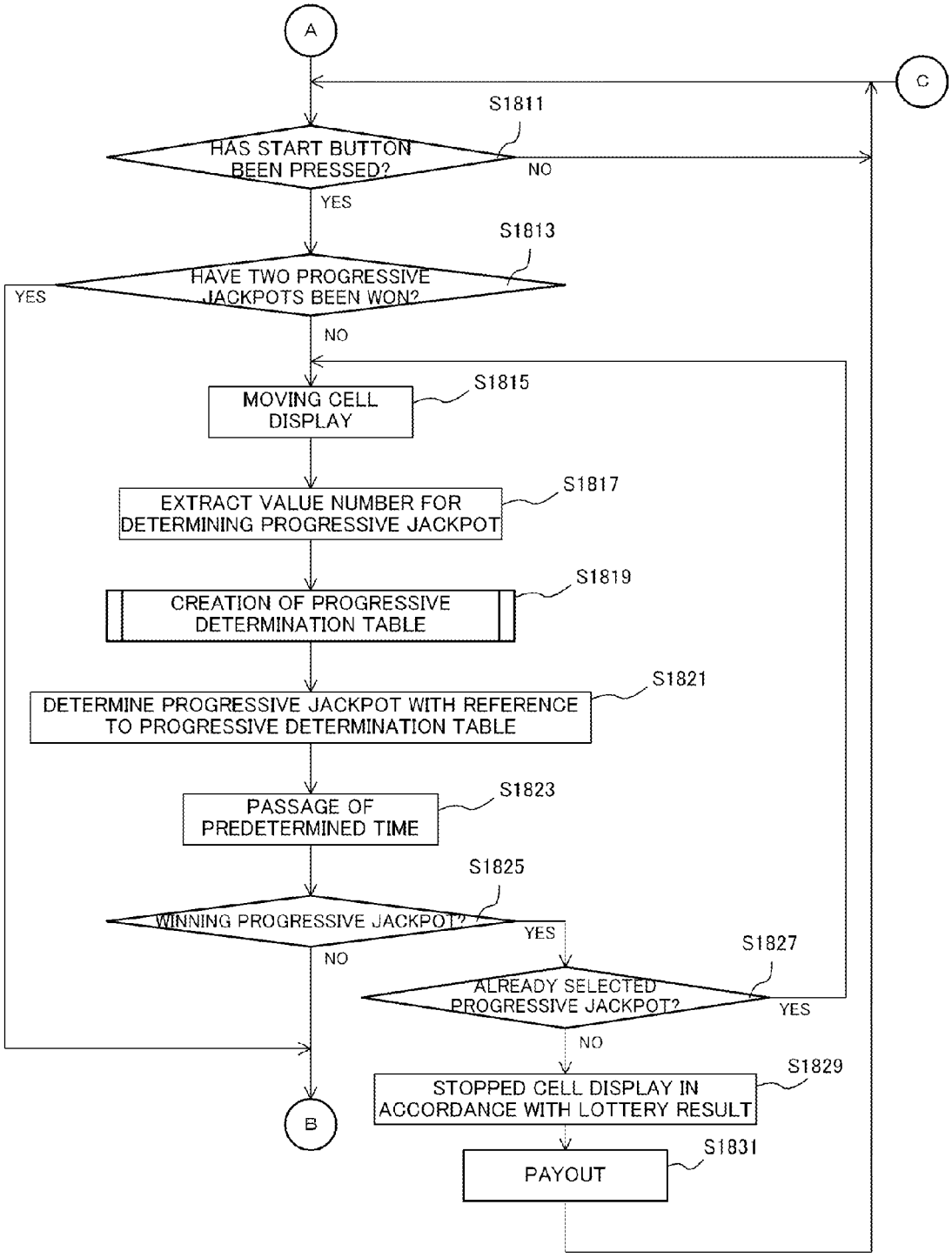
FIG. 18 is a flowchart of roulette game processing.
Figure 19:
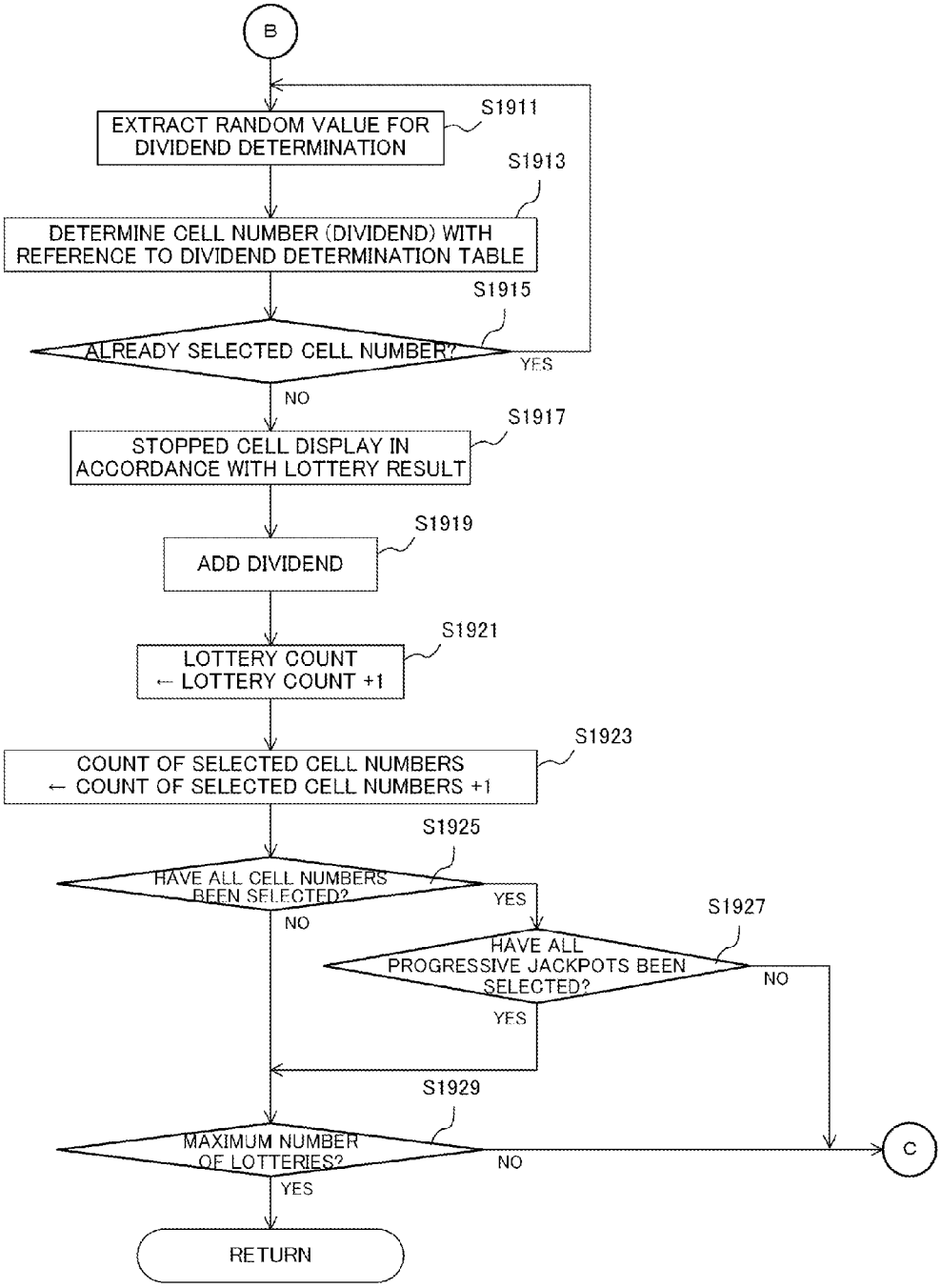
FIG. 19 is a flowchart of roulette game processing.

As illustrated in FIG. 1, a gaming machine according to the present embodiment is a gaming machine configured to determine a dividend based on rearranged symbols, the gaming machine comprising:

a display (e.g., a symbol display unit 40 or a video display unit 110, which will be described later) having a display area in which symbols associated with a plurality of scroll lines are displayed; and a controller (e.g., a main CPU 222, a ROM 224, and a RAM 226, which will be described later) for controlling base games, roulette games, and free games, in which game results are displayed in the display area, the controller being programmed to perform the processing of (1-1) to (1-5):

(1-1) in the base games, switching the base games to the roulette games under a condition that a trigger related to a number of trigger symbols occurs (e.g., Step S18 in FIG. 18);

(1-2) in the roulette games, determining a maximum number of lotteries based on the number of trigger symbols (e.g., Step S1723 in FIG. 17);

(1-3) determining a dividend in the free games or winning a jackpot by a lottery and switching the roulette games to the free games under a condition that a count of conducted lotteries reaches the maximum number of lotteries (e.g., the flowchart of FIGS. 18 and 19);

(1-4) in each of the roulette games, counting the conducted lottery in a case where the processing of (1-3) determines a dividend in the free games by the lottery (e.g., Step S1921 in FIG. 19); and (1-5) in each of the roulette games, repeating the processing of (1-3) without counting the conducted lottery in a case where the processing of (1-3) determines winning a jackpot by the lottery (e.g., Steps S1825 to S1831 in FIG. 18).

The gaming machine according to the present embodiment determines a dividend based on rearranged symbols. The gaming machine comprises a display and a controller.

The display has a display area in which symbols are displayed. The symbols are associated with a plurality of scroll lines. Scrolling of the plurality of scroll lines is stopped to rearrange symbols in the display area.

The display area shows a game result. The game result may be determined by the rearrangement of the symbols or other criterion. The controller controls base games, roulette games, and free games. The controller is programmed to perform the processing of (1-1) to (1-5).

The processing of (1-1) is, in the base games, switching the base games to the roulette games under a condition that a trigger related to a number of trigger symbols occurs.

The processing of (1-2) is, in the roulette games, determining a maximum number of lotteries based on the number of trigger symbols.

The processing of (1-3) is determining a dividend in the free games or winning a jackpot by a lottery and switching the roulette games to the free games under a condition that a count of conducted lotteries reaches the maximum number of lotteries.

The processing of (1-4) is, in each of the roulette games, counting the conducted lottery in a case where the processing of (1-3) determines a dividend in the free games by the lottery.

The processing of (1-5) is, in each of the roulette games, repeating the processing of (1-3) without counting the conducted lottery in a case where the processing of (1-3) determines winning a jackpot by the lottery.

In the case of winning a jackpot, the gaming machine repeats a lottery in the roulette games without increasing the count of lotteries. Accordingly, in the case of winning a jackpot, the number of lotteries to be conducted is not consumed, maintaining a chance to increase the dividend. Furthermore, since the winning of a jackpot does not affect the determination of the dividend, the player can receive the benefit by the jackpot and the benefit by the dividend separately. The player can feel expectation about which is to be determined, a jackpot or a dividend, through common lotteries in the roulette games.

Furthermore, in the gaming machine according to the present embodiment, it is preferable that the processing of (1-3) include the processing of:

(1-3-1) conducting a lottery for a jackpot (e.g., the flowchart of FIG. 18); and (1-3-2) after the processing of (1-3-1), conducting a lottery for a dividend in free games (e.g., the flowchart of FIG. 19).

This configuration allows the determination of winning a jackpot and determination of a dividend in free games to be made separately through common games of the roulette games, achieving simple processing. Furthermore, since the player can get both benefits of a jackpot and a dividend in free games through the common roulette games, the player can feel expectation about which prize can be gotten.

Furthermore, in the gaming machine according to the present embodiment, the jackpot is one of a plurality of kinds of jackpots (e.g., the roulette image in FIG. 29), and the controller is programmed to perform the processing of (2-1):

(2-1) in the roulette games, allowing all the plurality of kinds of jackpots to be won by lotteries (e.g., Steps S1825 to S1831 in FIG. 18).

Since there are a plurality of kinds of jackpot prizes, the player can feel expectation to win a jackpot. That is to say, for example, in the case where the existence of the plurality of kinds of jackpots is visualized on the display, the player can recognize that a plurality of kinds of jackpots exist. If the player knows the existence of the plurality of kinds of jackpots, the player can feel expectation to win at least one of the jackpots.

In addition, in the case of winning all the plurality of kinds of jackpots, the player can feel satisfaction of acquiring all and further, can get more benefit. If the plurality of kinds of jackpots include a jackpot to be easily won, the player can have a motivation to willingly accumulate his/her money to the jackpot so as to win the jackpot.

Furthermore, in the gaming machine according to the present embodiment, it is preferable that the processing of (1-3) include the processing of (2-3-1) to (2-3-3):

(2-3-1) conducting a lottery for a jackpot (e.g., Steps S1817 to S1821 in FIG. 18);

(2-3-2) performing the processing of (2-3-1) again in a case of winning any one of the plurality of kinds of jackpots (e.g., Steps S1825 to S1831 and Steps S1817 to S1821 in FIG. 18); and (2-3-3) conducting a lottery for a dividend in free games in a case of losing all of the plurality of kinds of jackpots (e.g., Step S1825 in FIG. 18).

Still further, in the gaming machine according to the present embodiment, it is preferable that the processing of (2-3-1) include the processing of (2-3-2-1):

(2-3-2-1) in a case of winning any one or more kinds of jackpots among the plurality of kinds of jackpots, conducting a lottery for a jackpot after excluding the one or more kinds of jackpots already won (e.g., Step 1827 and Steps 1817 to S1821 in FIG. 18).

This configuration prevents providing the same kind of jackpot to the player.

In the case of winning any one of the plurality of kinds of jackpots, the processing of conducting a lottery for a jackpot is performed again; the player can win a plurality of kinds of jackpots, particularly, all the plurality of kinds of jackpots. The player can get more benefit.

Furthermore, in the gaming machine according to the present embodiment, the dividend in the free games is one of a plurality of kinds of dividends (e.g., the roulette image in FIG. 29), and the controller is programmed to perform the processing of (3-1):

(3-1) in the roulette games, increasing a probability to win a jackpot depending on a number of kinds of dividends in the free games determined by lotteries (e.g., the progressive determination table in FIG. 26).

With increase in number of kinds of dividends determined by lotteries in the roulette games, the probability to win a jackpot increases. Accordingly, as the number of kinds of dividends increases, the player can feel higher expectation to win a jackpot. Since the determination of dividend can affect the possibility of winning a jackpot, the roulette games can attain uniformity.

Furthermore, it is preferable that the gaming machine according to the present embodiment further comprises a memory for storing:

the number of kinds of dividends determined through the processing of (1-3) (e.g., S1923 in FIG. 19); and a lottery table defining probabilities to win a jackpot in such a manner that the probability to win a jackpot increases as the number of determined kinds of dividends increases (e.g., the progressive determination table in FIG. 26), and that the processing of (3-1) include the processing of (3-1-1) and (3-1-2):

(3-1-1) retrieving the number of kinds of dividends determined through the processing of (1-3) from the memory (e.g., S2115 and S2117 in FIG. 21); and (3-1-2) conducting a lottery for a jackpot based on the retrieved number of kinds of dividends with reference to the lottery table (e.g., S1817 and S1821 in FIG. 18).

Determining in advance the probabilities to win a jackpot in the lottery table can achieve payout well-balanced between the player's benefit and the benefit of the amusement facility, while increasing the expectation of the player (X-1) In the free game mode, if retrigger occurs, the game mode returns to the roulette game mode.

(X-2) When the requirement to exit the free game mode is satisfied, the game mode returns from the free game mode to the base game mode.

Embodiment of Gaming Machine

Hereinafter, a gaming machine according to an embodiment of the present invention is described by way of example of a slot machine 10.

<<Game System>>

Figure 2:
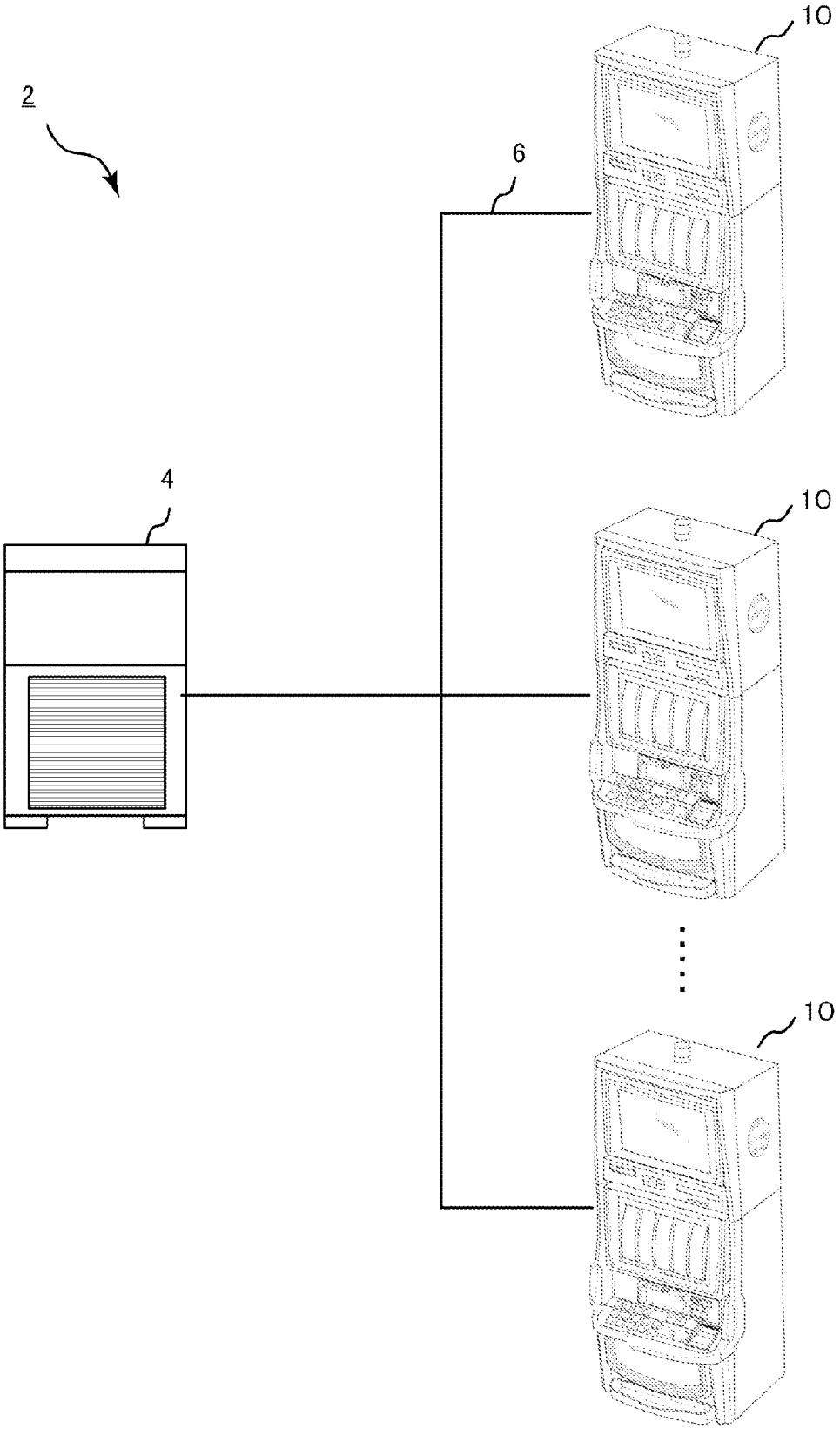
FIG. 2 is a drawing illustrating a game system including gaming machines.

FIG. 2 is a diagram illustrating a game system including the slot machine 10.

The game system 2 includes a plurality of slot machines 10 and an external control apparatus 4 connected with the slot machines 10 via a communication line 6.

The external control apparatus 4 controls the slot machines 10. In this embodiment, the external control apparatus 4 is a so-called hall server installed in an amusement facility having the slot machines 10. Each slot machine 10 has a unique identification number; the external control apparatus 4 identifies the source of data sent from one of the slot machines 10 with an identification number. In sending data to a slot machine 10, the external control apparatus 4 specifies the destination with an identification number.

The game system 2 may be constructed in a single amusement facility providing various games, such as a casino, or may be constructed among a plurality of amusement facilities. In the case of a single amusement facility, the game system 2 may be constructed on each floor or in each section. The communication line 6 may be either wired or wireless, and either a private line or a switched line.

<Stand-Alone Progressive Jackpot>

Upon winning a jackpot, each of the slot machines 10 releases a stand-alone progressive jackpot. The stand-alone progressive jackpot is a feature that pays out from a jackpot amount, which is an accumulation of a part of the coins used by players in a slot machine 10, upon winning a jackpot. Unlike the later-described link progressive jackpot, the jackpot amount to be paid out is pooled in a slot machine 10, independently from the other slot machines 10. This means that a part of the coins used by the same player is paid out as a jackpot prize but the coins pooled in the other slot machines 10 by the other players as a jackpot amount are not to be paid out.

In the present embodiment, there are two kinds of jackpot prizes for the stand-alone progressive jackpot: Major Progressive Jackpot and Minor Progressive Jackpot. Major Progressive Jackpot provides a high dividend and Minor Progressive Jackpot provides a dividend lower than Major Progressive Jackpot. Winning Major Progressive Jackpot and Minor Progressive Jackpot will be described later.

<Link Progressive Jackpot>

The game system 2 can also offer a common game called a link progressive jackpot to be participated by a plurality of slot machines 10. In the common game, the link progressive jackpot is a feature that pays out from a jackpot amount, which is an accumulation of parts of coins used by players in the slot machines 10. The game system 2 may pay out a jackpot amount to the player of the slot machine 10 that has satisfied requirements to release the link progressive jackpot. For example, the link progressive jackpot is released as follows.

The game system 2 releases the link progressive jackpot when a combination of symbols for a jackpot trigger appears in one of the slot machines 10.

Each slot machine 10 calculates an amount (contribution) to be pooled to the jackpot amount in each unit game and sends it to the external control apparatus 4. The external control apparatus 4 accumulates the amounts to be pooled sent from the slot machines 10 in the jackpot amount. The game system 2 releases the link progressive jackpot when specified symbols are aligned on a payline. Alternatively, the game system 2 may release the link progressive jackpot when an average of the accumulations of the slot machines 10 reaches a predetermined amount. Still alternatively, the game system 2 may release the link progressive jackpot when the total amount of the accumulations of all the slot machines 10 reaches a predetermined amount.

<<Configuration of Slot Machine 10>>

Figure 3:
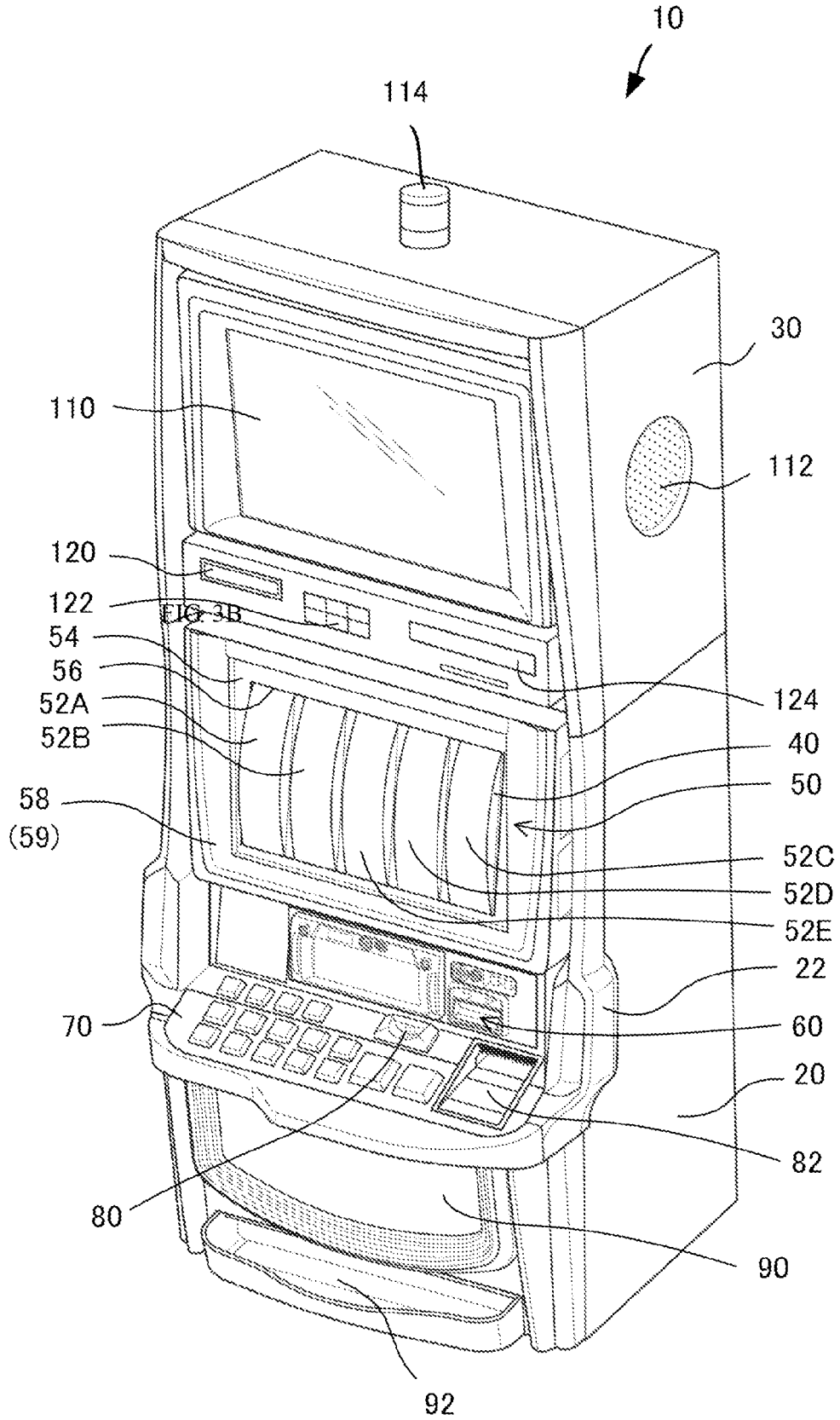
FIG. 3 is a drawing illustrating an overall configuration of a gaming machine.

FIG. 3 illustrates an overall configuration of a slot machine 10 according to the present embodiment.

The slot machine 10 accepts coins, bills, and electronic information equivalent to these as game media. The slot machine 10 also accepts credits stored in barcode tickets or IC cards as game media. The game media are not limited to the foregoing, but other kinds of media also can be used.

The slot machine 10 shown in FIG. 3 includes a cabinet 20, a top box 30 placed on the cabinet 20, and a main door 22 mounted on the front of the cabinet 20.

A symbol display unit 40 including a reel assembly 50 is provided on the main door 22. In this embodiment, the reel assembly 50 includes five reels 52A to 52E. Each of the reels 52A to 52E has a drum with a plurality kinds of symbols disposed on its outer circumferential surface. The symbol display unit 40 is attached to the front of the reel assembly 50 and includes a reel cover 54 having a display window 56. The reel cover 54 is provided outside so that the player can see a part of the reels 52A to 52E. The reel cover 54 is provided on a display panel 58. The reel cover 54 is preferably made of a transparent liquid crystal panel. The symbol display unit 40 includes a touch panel 59 to detect the player's touch input.

When the reels 52A to 52E are still, three of the symbols on each of the reels 52A to 52E can be seen in the display window 56. In this state, a symbol matrix of three rows and five columns is formed in the display window 56. In the display window 56, one or more lines are prepared as paylines for determining winning or losing. In this embodiment, thirty paylines are prepared.

Each time a unit game is performed, the reels 52A to 52E with symbols spin at a predetermined speed and then stop to rearrange the symbols, showing a part of the symbols in the display window 56. The rearranged symbols in the display window 56 determine the result of the unit game. A benefit associated with the result of the unit game is given to the player. For example, if the rearranged symbols make some winning combination along one of the paylines, a predetermined amount of payout is given to the player.

The symbols include so-called scatter symbols. The scatter symbols are to determine winning or losing depending on the number of scatter symbols appearing in the rearranged symbols, regardless of the paylines. The prizes include providing payout and entering bonus games (free games). In the case of payout, the amount of payout can be increased with the number of appearing scatter symbols. In this embodiment, the scatter symbols are BONUS symbols.

The rearranged symbols determine the game mode of the subsequence unit games. The present embodiment provides a base game mode, a roulette game mode, and a free game mode for game modes, which will be described in detail in the following description. The roulette game mode and the free game mode may be generally called a feature game mode. In each of the base game mode, the roulette game mode, and the free game mode in the present embodiment, at least one unit game is performed.

In this description, a unit game in the base game mode is defined as a game in a period from the start of crediting to start the game until the end of closing the game, such as paying out in accordance with the game result of rearranged symbols in the display window 56 after the reels 52A to 52E are stopped. Alternatively, the start of a game in the base game mode can be defined to be the time an operation related to the start of a game, such as a bet operation or an operation of the START button 79, is performed by a player.

In the case of the free game mode, there is no bet operation by the player; accordingly, when credit processing is performed inside the slot machine 10 or the START button 79 is operated by the player can be defined as the start of a game.

In the case of the roulette game mode, there is no bet operation by the player, either; accordingly, when the START button 79 is operated by the player can be defined as the start of a game.

In the meanwhile, unit games in the roulette game mode do not rearrange the symbols. Accordingly, the end of a unit game in the roulette game mode can be defined to be the time the processing in accordance with a game result determined in the roulette game mode is performed or the game result comes out.

In the cases of the base game mode and the free game mode, however, a game result is determined based on the rearranged symbols. Accordingly, the processing in accordance with a game result determined based on the rearranged symbols can be defined as game closing processing. For example, in the case of winning, when a payout corresponding to the prize is made can be defined as the end of the game. The time of determination to enter a bonus game such as a free game may also be defined as the end of the game.

The display panel 58 shows an amount of bet and an amount of credit in a specific area. The amount of credit indicates the number of the player's coins deposited in the slot machine 10. The amount of payout indicates the number of coins to be given to the player when a winning combination is complete.

In this embodiment, the slot machine 10 employs mechanical reels 52A to 52E. Instead of the mechanical reels, video reels or a combination of mechanical reels and video reels can be used.

Below the symbol display unit 40, an IC card reader 60 is provided. The IC card reader 60 accepts an IC card. The IC card stores identification information on the player or specific data such as game log data of the games previously played by the player. The IC card is able to store data equivalent to coins, bills, or credit owned by the player. The IC card reader 60 reads and writes an IC card inserted therein. Preferably, the IC card reader 60 has a liquid crystal display for showing the data read from the IC card.

In front of the lower end of the IC card reader 60, a control panel 70 is provided. On the control panel 70, buttons, a coin entry 80, and a bill entry 82 are provided.

Figure 4:
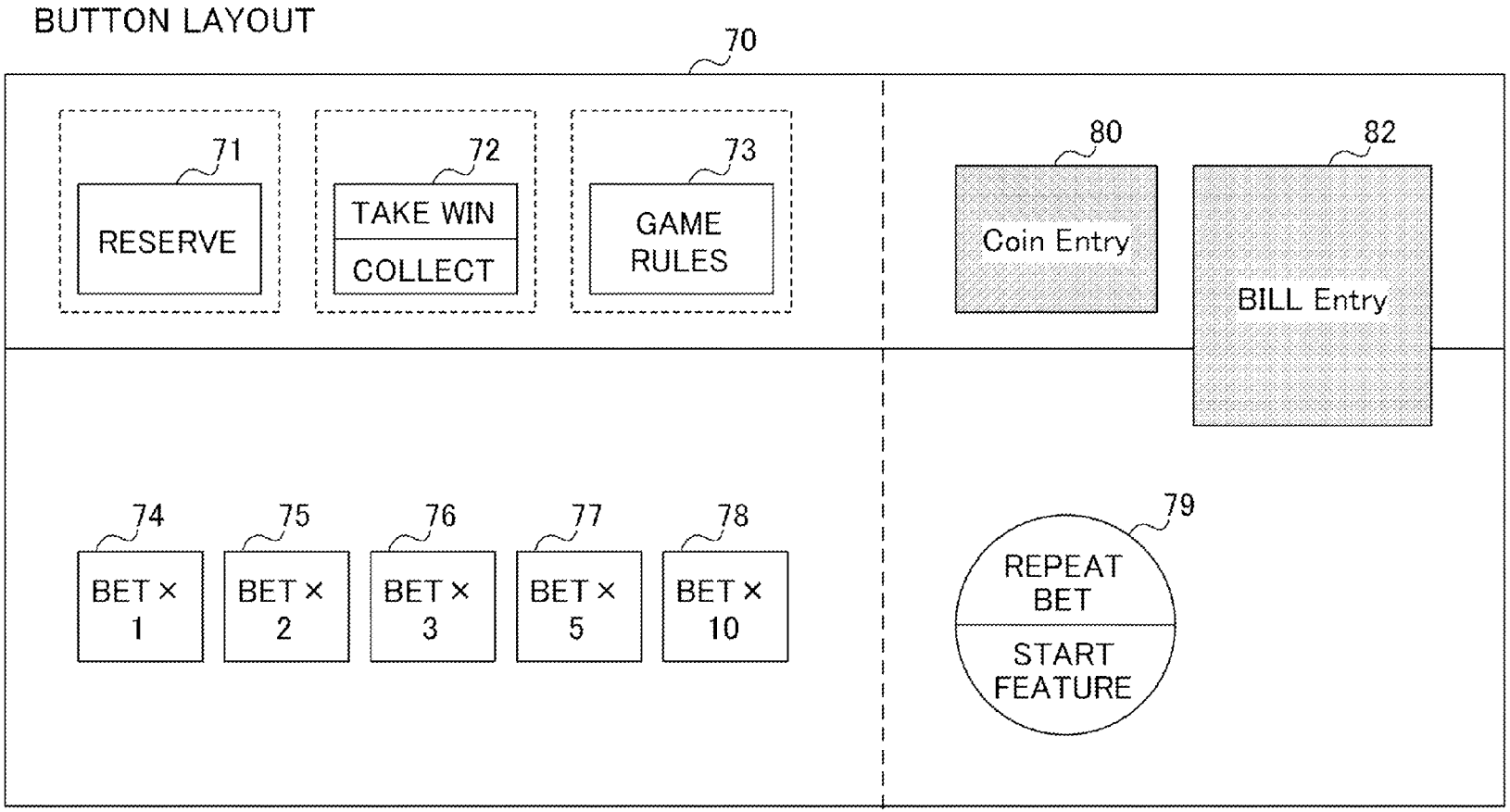
FIG. 4 is a diagram schematically illustrating a layout of the buttons on the control panel of the gaming machine.

FIG. 4 is a diagram schematically illustrating a layout of the buttons on the control panel of the slot machine 10 illustrated in FIG. 3. As illustrated in FIG. 4, a RESERVE button 71, a COLLECT button 72, and a GAME RULES button 73 are provided on the upper left of the control panel 70.

On the lower left of the control panel 70, a 1-BET button 74, a 2-BET button 75, a 3-BET button 76, a 5-BET button 77, and a 10-BET button 78 are provided. Further, a START button 79 is provided on the lower middle of the control panel 70. The coin entry 80 is provided on the upper middle of the control panel; the bill entry 82 is provided on the right of the control panel 70.

The RESERVE button 71 is used when the player leaves the machine for a minute or wants to ask a staff of the amusement facility for exchange. The RESERVE button 71 is also used to store the remaining credit to the IC card inserted in the IC card reader 60. The COLLECT button 72 is used to instruct the slot machine 10 to pay out the credited coins to a coin tray 92. If the player is unfamiliar with the rules of the game or the operation of the machine, the GAME RULES button 73 is used. In response to a press of the GAME RULES button 73, a variety of help information comes up on the video display unit 110.

The BET buttons 74 to 78 are used to set the amount of bet. Each time the player presses the 1-BET button 74, one credit is bet on each active payline from the player's current credit. If the player presses the 2-BET button 75, two credits are bet on each active payline to start a unit game. If the player presses the 3-BET button 76, three credits are bet on each active payline to start a unit game. If the player presses the 5-BET button 77, five credits are bet on each active payline to start a unit game. If the player presses the 10-BET button 78, ten credits are bet on each active payline to start a unit game. The START button 79 (so-called spin button) is used to instruct the reels 52A to 52E to start spinning under the bet condition determined before.

The gaming machine in the present embodiment can change the bet pattern. There are four bet patterns: the first bet pattern is "1", "2", "3", "4", and "5"; the second bet pattern is "1", "2", "3", "5", and "10"; the third bet pattern is "1", "2", "5", "10", and "15"; and the fourth bet pattern is "1", "2", "5", "10", and "20". In the gaming machine in the present embodiment, the second bet pattern is set as a default. The bet pattern can be selected by an operation of a hall staff of the amusement facility such as a casino. Alternatively, the bet pattern may be selected by an operation of the player to reflect the player's intention.

In the case where the first bet pattern is selected, an operation of the 1-BET button 74 results in a bet of "1"; an operation of the 2-BET button 75 results in a bet of "2"; an operation of the 3-BET button 76 results in a bet of "3"; an operation of the 5-BET button 77 results in a bet of "4"; and an operation of the 10-BET button 78 results in a bet of "5".

In the case where the second bet pattern is selected, an operation of the 1-BET button 74 results in a bet of "1"; an operation of the 2-BET button 75 results in a bet of "2"; an operation of the 3-BET button 76 results in a bet of "3"; an operation of the 5-BET button 77 results in a bet of "5"; and an operation of the 10-BET button 78 results in a bet of "10".

In the case where the third bet pattern is selected, an operation of the 1-BET button 74 results in a bet of "1"; an operation of the 2-BET button 75 results in a bet of "2"; an operation of the 3-BET button 76 results in a bet of "5"; an operation of the 5-BET button 77 results in a bet of "10"; and an operation of the 10-BET button 78 results in a bet of "15".

In the case where the fourth bet pattern is selected, an operation of the 1-BET button 74 results in a bet of "1"; an operation of the 2-BET button 75 results in a bet of "2"; an operation of the 3-BET button 76 results in a bet of "5"; an operation of the 5-BET button 77 results in a bet of "10"; and an operation of the 10-BET button 78 results in a bet of "20".

When the coin entry 80 receives coins, the coins are guided to a hopper in the cabinet 20. When the bill entry 80 receives a bill, it determines whether the inserted bill is genuine and accepts it into the cabinet 20 only if it is genuine.

On the lower front of the main door 22 and below the control panel 70, a bottom glass 90 and a coin tray 92 are provided. On the bottom glass 90, an illustration of a character of the slot machine may be printed. The coin tray 92 receives coins paid out from the cabinet 20.

As shown in FIG. 3, the video display unit 110 including a liquid crystal panel is provided on the front of the top box 30. The video display unit 110 produces video performances to increase the fun of the game. The video display unit 110 also shows information such as rules of the game and operation instructions. Speakers 112 and a lamp 114 are respectively provided on the sides and the top of the top box 30. The slot machine 10 increases the fun of the game by sound performances and lighting performances with the speakers 112 and the lamp 114.

On the lower part of the video display unit 110, a ticket printer 120, a keypad 122, and a data display 124 are provided.

The ticket printer 120 prints a barcode including credit data, a date, a time, and an ID number of the slot machine 10 on a ticket and ejects the ticket as a barcode ticket. The player can exchange the barcode ticket with money or other thing at a predetermined place in the amusement facility (for example, a cashier in a casino).

The keypad 122 has a plurality of keys. The player operates the keys to enter instructions about issuance of a barcode ticket. The data display 124 having a vacuum fluorescent display or an LED shows data entered by the player through the keypad 122.

<<<Electric Configuration of Slot Machine>>>

Figure 5:
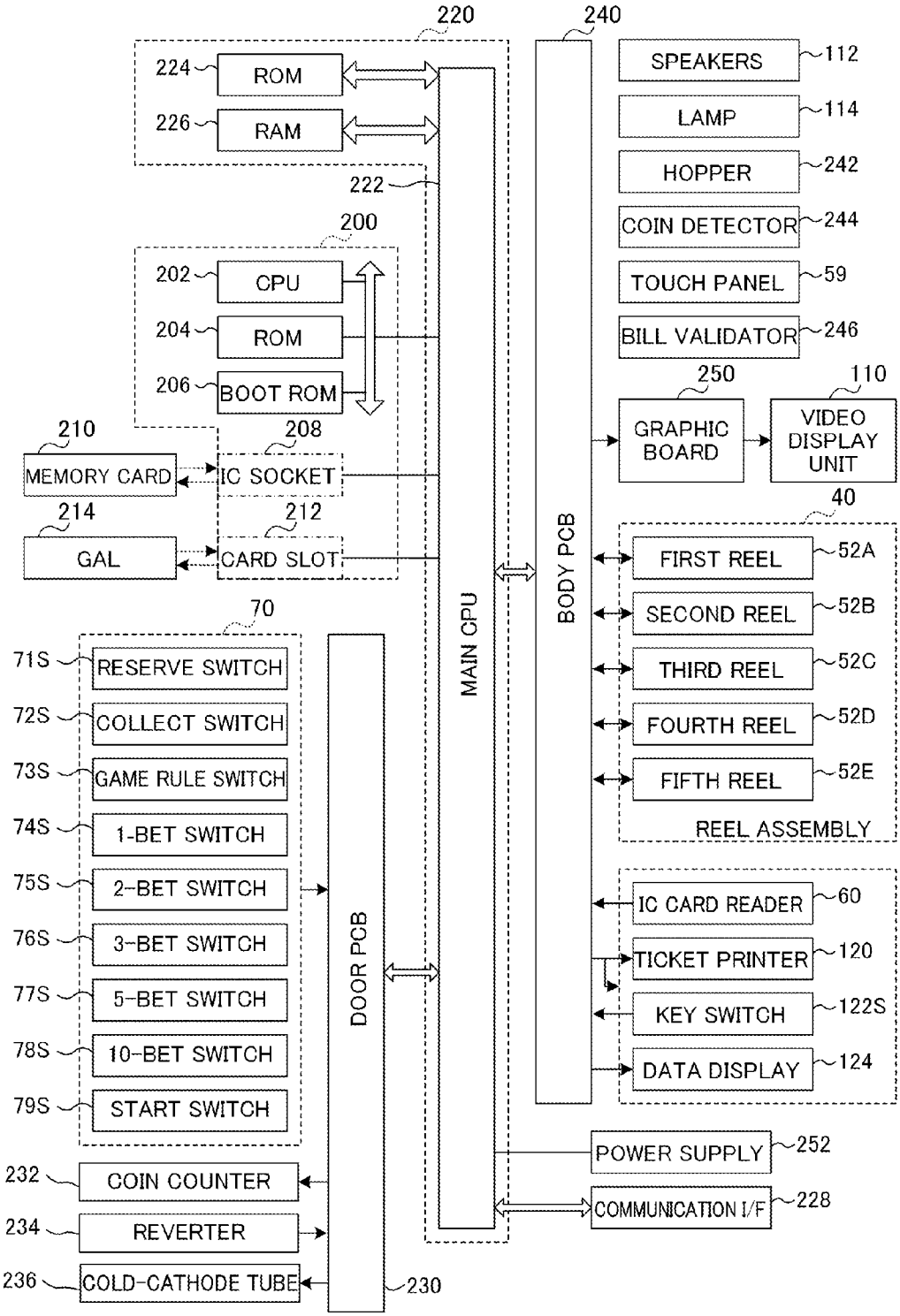
FIG. 5 is an electric block diagram of the gaming machine.

FIG. 5 is an electric block diagram of the slot machine 10 shown in FIG. 3. The slot machine 10 includes a game board 200, a mother board 220, a door PCB 230, and a body PCB 240.

The game board 200 includes a CPU 202, a ROM 204 accessible from the CPU 202 via an internal bus, and a boot ROM 206 accessible from the CPU 202 via an internal bus. The game board 200 further includes an IC socket 208 to accommodate and communicate with a memory card 210, and a card slot 212 provided for generic array logic (GAL) 214.

The memory card 210 includes a non-volatile memory and holds a game program and a game system program.

The IC socket 208 is structured so that a memory card 210 is removable. The IC socket 208 is connected to the mother board 220 via an IDE bus. The game executed in the slot machine 10 can be changed by replacing the memory card 210 with another card. The game executed in the slot machine 10 can also be changed by removing the memory card 210 from the IC socket 208, rewriting a different program to the memory card 210, and inserting the memory card 210 again to the IC socket 208.

The GAL 214 is a kind of programmable logic device (PLD) having a fixed OR array structure and has multiple input ports and output ports. When the GAL 214 receives specific data via an input port, it outputs data corresponding to the input data via an output port.

The card slot 212 is structured so that the GAL 214 can be inserted to or removed from the card slot 212, and is connected to the mother board 220 via a PCI bus.

The CPU 202, the ROM 204, and the boot ROM 206 interconnected via an internal bus are connected to the mother board 220 via the PCI bus. The PCI bus enables signal transmission between the mother board 220 and the game board 200 and supply of power from the mother board 220 to the game board 200.

The ROM 204 stores programs. The boot ROM 206 stores a preliminary authentication program and a boot code to be used by the CPU 202 to start the preliminary authentication program. The authentication program is a tamper check program for verifying whether the game program and the game system program are authentic. The preliminary authentication program is a program for verifying whether the authentication program is authentic. The authentication program and the preliminary authentication program are written so as to perform verification that the target program is not tampered.

The mother board 220 is a commonly available main board to execute a game program and a game system program. The mother board 220 includes a main CPU 222, a ROM 224, a RAM 226, and a communication interface 228.

The ROM 224 is a memory device to store programs to be executed by the main CPU 222. The ROM 224 non-transitorily stores programs, for example BIOS, with other data. The ROM 224 can be a flash memory. When the BIOS program is executed by the main CPU 222, it initializes the peripheral devices. The BIOS program loads a game program and a game system program held in the memory card 210 via the game board 200. The ROM 224 may be rewritable. Alternatively, the ROM 224 may be write-protected.

The RAM 226 stores data and programs to be used during the operation of the main CPU 222. For example, to load a game program, a game system program, or an authentication program, the RAM 226 can store the program. The RAM 226 has working space to execute such a program. Specifically, the working space stores the number of bets, the amount of payout, and the amount of credit and holds them during execution of the game. The RAM 226 also holds tables for defining symbols, symbol codes, winning combinations, and their probabilities during the game. Furthermore, the RAM 226 stores a symbol code determination table. The symbol code determination table holds mapping information between symbol codes and random numbers to be used to determine a symbol based on a random number. In particular, the RAM 226 holds a mode flag together with a game counter. The mode flag indicates the game mode. The game counter indicates a count value representing the number of unit games executed in a free game mode or the number of unit games remaining in the free game mode.

The RAM 226 also stores count values of a plurality of counters. The plurality of counters include a bet counter, a payout counter, a credit counter, and a free game mode game counter for counting the unit games in a free game mode. Some of the count values may be held in the internal register of the main CPU 222.

The main CPU 222 communicates with an external controller via the communication interface 228. For example, the external controller may be a server (not-shown) connected via a communication channel.

The mother board 220 is connected with the door PCB 230 and the body PCB 240. The mother board 220 can communicate with the door PCB 230 and the body PCB 240 using USB. The mother board 220 is also connected to a power supply 252. The main CPU 222 of the mother board 220 activates and operates using the power supplied from the power supply 252. The mother board 220 supplies a part of the power to the game board 200 via the PCI bus to activate the CPU 202. The door PCB 230 and the body PCB 240 are connected with input devices. Examples of the input devices are switches, sensors, and peripheral devices whose operation is controlled by the main CPU 222. The door PCB 230 is connected with a control panel 70, a coin counter 232, a reverter 234, and a cold-cathode tube 236.

The control panel 70 includes a reserve switch 71S, a collect switch 72S, a game rule switch 73S, a 1-BET switch 74S, a 2-BET switch 75S, a 3-BET switch 76S, a 5-BET switch 77S, a 10-BET switch 78S, and a start switch 79S, which are respectively associated with the buttons 71 to 79. The switches 71S to 79S detect that the buttons 71 to 79 are pressed by the player and output signals to the main CPU 222.

The coin counter 232 and the reverter 234 are installed in the coin entry 80. The coin counter 232 determines whether each coin put in the coin entry 80 is genuine from the characteristics of the coin, such as the material and the shape of the coin. If it detects a genuine coin, the coin counter outputs a signal to the main CPU 222. A coin determined to be fake is ejected to the coin tray 92. The reverter 234 operates in accordance with a control signal from the main CPU 222. The reverter 234 supplies the coin determined to be genuine by the coin counter 232 to the hopper 242 or a cash box (not shown). If the hopper 242 is not filled with coins, the coin is guided to the hopper 242. Contrarily, if the hopper 242 is filled with coins, the coin is guided to the cash box.

The cold-cathode tube 236 is installed behind the video display unit 110. The cold-cathode tube 236 functions as a backlight and illuminates in accordance with a control signal from the main CPU 222.

The body PCB 240 is connected with the speakers 112, the lamp 114, the hopper 242, the coin detector 244, the touch panel 59, the bill validator 246, the reel assembly 50, the IC card reader 60, the graphic board 250, the ticket printer 120, the key switch 122S, and the data display 124.

The lamp 114 comes on and off in accordance with a control signal from the main CPU 222. The speakers 112 output sound such as BGM in accordance with a control signal from the main CPU 222.

The hopper 242 operates in accordance with a control signal from the main CPU 222 to pay out the specified amount of payout to the coin tray 92 via a coin payout exit (not shown) provided between the bottom glass 90 and the coin tray 92. The coin detector 244 detects coins paid out from the hopper 242 to output a detection signal to the main CPU 222.

The touch panel 59 detects a position touched by the player and supplies a positional detection signal corresponding to the detected point to the main CPU 222. The bill validator 246 provided at the bill entry 82 supplies a bill detection signal corresponding to the amount of a detected genuine bill to the main CPU 222 upon detection.

The graphic board 250 controls the video display unit 110 and the display panel 58 of the symbol display unit 40 in accordance with control signals from the main CPU 222. The graphic board 250 includes a video display processor (VDP) for creating video data and a video RAM for transitorily storing video data. The video data is created by a game program stored in the RAM 226.

The IC card reader 60 retrieves data held in an IC card inserted in the IC socket 208 and supplies the retrieved data to the main CPU 222. The IC card reader 60 also writes data supplied to the main CPU 222 to the ID card.

The ticket printer 120 prints a barcode including information such as the amount of credit stored in the RAM 226, time and date, and the identification number of the slot machine 10 on a ticket in accordance with a control signal from the main CPU 222 to output a barcode ticket.

The key switch 122S is provided under the keypad 122 and outputs a key detection signal to the main CPU 222 when the keypad 122 is pressed by the player.

The data display 124 shows information related to information entered via the keypad 122 in accordance with a control signal from the main CPU 222.

<<Electric Circuitry of Reel Assembly>>

Figure 6:
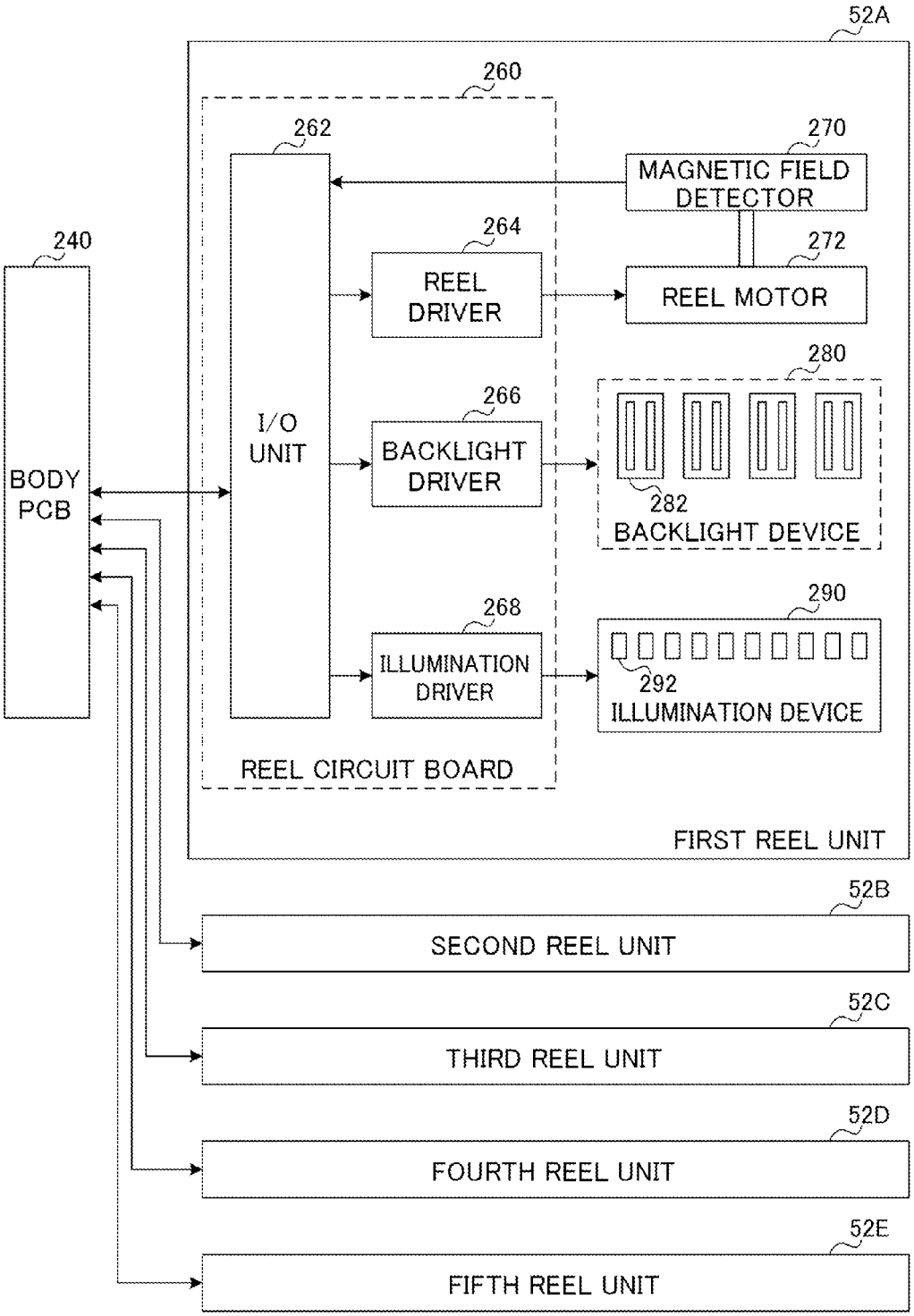
FIG. 6 is a block diagram illustrating electric circuitry of a reel assembly.

FIG. 6 is a block diagram illustrating electric circuitry of the reel assembly.

As shown in FIG. 6, the body PCB 240 is electrically connected to the reel assembly 50. As mentioned above, the reel assembly 50 includes the first to the fifth reels 52A to 52E. Each of the reels 52A to 52E is provided on a reel circuit board 260. The reel circuit board 260 includes an input/output (I/O) unit 262 which is communicable with the body PCB 240. The reel circuit board 260 also includes a reel driver 264, a backlight driver 266, and an illumination driver 268 which are connected with the I/O unit 262.

The I/O unit 262 is connected with a magnetic field detector 270. The magnetic field detector 270 includes a magnetic sensor for sensing the intensity of magnetic field and outputting a magnetism detection signal proportional to the intensity of the magnetic field and a sensor fixer for fixing the magnetic sensor to a predetermined position. The magnetic sensor senses the intensity of magnetic field generated by a magnet. The magnet is attached to a rotary shaft of a reel motor 272 and rotates with the reel 52A.

The reel driver 264 supplies electric power to the reel motor 272. The backlight driver 266 supplies electric power to lights 282 of a backlight device 280 separately. The illumination driver 268 supplies electric power to lights 292 of an illumination device 290 separately.

The second to the fifth reels 52B and 52E have the same configuration as the first reel 52A; the detailed explanation thereof is omitted.

<<Processing of Game Program>>

Figure 7:
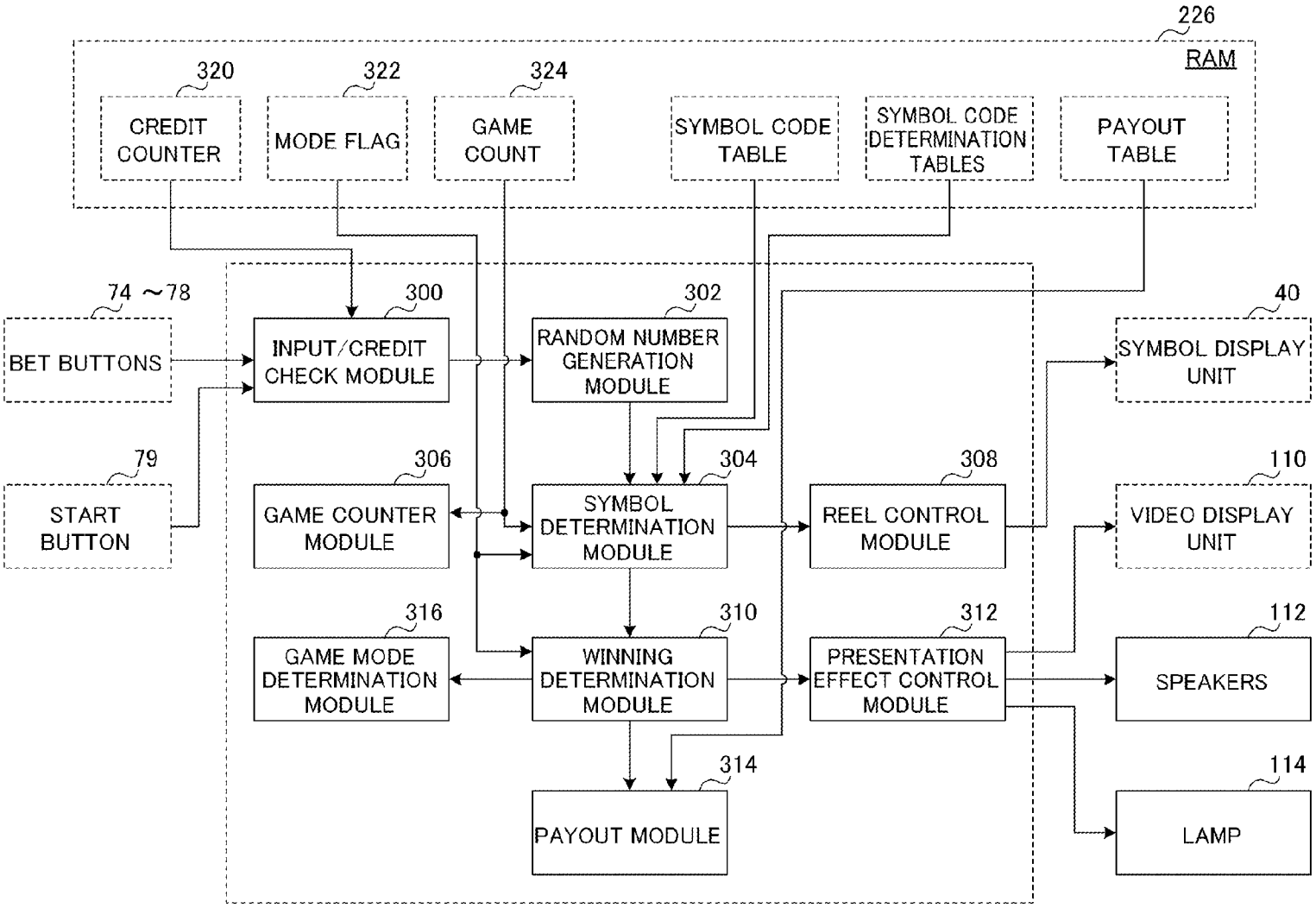
FIG. 7 is a block diagram illustrating processing of a game program executed by the main CPU of the mother board.

FIG. 7 is a block diagram illustrating processing of a game program executed by the main CPU 222 of the mother board 220. When power is supplied to the slot machine 10, the main CPU 222 retrieves the authenticated game program and game system program from the memory card 210 via the game board 200 and writes them to the RAM 226. The game program is executed in such a loaded state in the RAM 226.

In a preferred embodiment, the game program is executed by an input/credit check module 300, a random number generation module 302, a symbol determination module 304, a game counter module 306, a reel control module 308, a winning determination module 310, a presentation performance control module 312, a payout module 314, and a game mode determination module 316.

It should be noted that, the input/credit check module 300 may be an independent input/credit check device 300'; the random number generation module 302 may be an independent random number generation device 302'; the symbol determination module 304 may be an independent symbol determination device 304'; the game counter module 306 may be an independent game counter device 306'; the reel control module 308 may be an independent reel control device 308'; the winning determination module 310 may be an independent winning determination device 310'; the presentation performance control module 312 may be an independent presentation performance control device 312'; the payout module 314 may be an independent payout device 314'; and the game mode determination module 316 may be an independent game mode determination device 316'. In this way, the game program can be an aggregate of independent devices. Alternatively, some of these devices may be integrated into a device. In any case, it is sufficient as far as the processing modules may be software or hardware such as components, devices, or units that can execute the game program.

<Input/Credit Check Module 300>

The input/credit check module 300 continuously checks whether any of the BET buttons 74 to 78 or the START button 79 is pressed in an idle state where the reels 52A to 52E are still. Upon detection of pressing one of the BET buttons 74 to 78 or the START button 79, the input/credit check module 300 checks whether any credit remains for the player with reference to the credit counter 320 held in the RAM 226. If the player has at least one credit, the input/credit check module 300 invokes the random number generation module 302.

The random number generation module 302 generates random numbers to be used by the symbol determination module 304. In this embodiment, the random number generation module 302 generates five random numbers. The five random numbers are individually used for the first to the fifth reels 52A to 52E.

After extracting all the five random numbers, the symbol determination module 304 determines symbols to be stopped for the reels 52A to 52E separately with reference to a symbol code determination table held in the RAM 226. The symbol determination module 304 determines five symbols to be stopped for the reels 52A to 52E and shows the symbols to be stopped for the reels 52A to 52E in the display window 56 of the symbol display unit 40.

In particular, the symbol determination module 304 refers to the mode flag 322 held in the RAM 226 to find the current game mode. For the game modes in the present embodiment, there are a base game mode, a roulette game mode, and a free game mode. The number of chance games (unit games) executable per free game mode is predetermined, for example, to be seven. To limit the number of chance games, the game counter module 306 counts the chance games executed in the present free game mode or the chance games remaining in the present free game mode. The value of the game count 324 is stored in the RAM 226. The game counter module 306 may belong to the symbol determination module 304.

The reel control module 308 controls the reel assembly 50 by supplying stop position information for the determined symbols. Consequently, the spinning reels 52A to 52E stop at the positions specified by the stop position information. That is to say, the symbols are scrolled with the spin of the reels 52A to 52E. Then, the reel control module 308 stops the reels 52A to 52E so that the determined symbols will be rearranged at the vertically middle of the display window 56 of the symbol display unit 40.

The winning determination module 310 determines whether the rearranged symbols make a specific winning combination. If the rearranged symbols make a winning combination, the presentation performance control module 312 controls the symbol display unit 40 and other devices, such as the speakers 112, the lamp 114, and the video display unit 110. The presentation performances include performances by video and audio and performances by backlight change and illumination. The payout module 314 determines the amount of payout depending on the completed winning combination and provides the amount of payout to the player.

Each time a unit game ends, the game mode determination module 316 determines the game mode of the next unit game. If the rearranged symbols generate a trigger event in the base game mode, the game mode determination module 316 switches the game mode from the base game mode to the roulette game mode. When the roulette game mode ends, the game mode determination module 316 switches the game mode from the roulette game mode to the free game mode. Further, if an exit requirement is satisfied in the free game mode, the game mode determination module 316 switches the free game mode into the base game mode. In the other situations, the game mode determination module 316 maintains the current game mode. The game mode determination module 316 may belong to the winning determination module 310.

<<Payline Definition Table>>

FIG. 8 illustrates a payline definition table provided in the preferred embodiment of the present invention. In the present embodiment, thirty paylines of No. 1 to No. 30 are defined for a symbol matrix. In this description, the "first reel" means the reel 52A; the "second reel" means the reel 52B; the "third reel" means the reel 52C; the "fourth reel" means the reel 52D; and the "fifth reel" means the reel 52E. In the payline definition table of FIG. 8, the value "0" represents the position of the top row (the first row) in the display window 56; the value "1" represents the position of the middle row (the second row) in the display window 56; and the value "2" represents the position of the bottom row (the third row) in the display window 56.

For example, the No. 1 payline indicates all "1", meaning that the payline is "the middle row"-"the middle row"-"the middle row"-"the middle row"-"the middle row". The No. 15 payline indicates "2"-"0"-"0"-"0"-"2", meaning that the payline is "the bottom row"-"the top row"-"the top row"-"the top row"-"the bottom row". The No. 27 payline indicates "2"-"2"-"1"-"0"-"0", meaning that the payline is "the bottom row"-"the bottom row"-"the middle row"-"the top row"-"the top row".

If symbols of any winning combination are aligned along any one of these 30 paylines of No. 1 to No. 30 at rearrangement of the symbols, winning is determined and a payout corresponding to the prize is given to the player. As described above, in the case of scatter symbols, the number of scatter symbols appearing in the display window 56 determines winning or losing, regardless of these paylines.

In the present embodiment, all the 30 paylines of No. 1 to No. 30 are always effective regardless of the bet operation of the player.

The number of paylines is not limited to 30; it may be more than 30 or less than 30. Alternatively, effective paylines may be determined in accordance with the bet operation of the player. The total number of paylines can be changed with the size of the symbol matrix; other paylines can be defined as necessary.

<<Symbol Code Determination Table>>

FIG. 9 illustrates an example of a symbol code determination table defining symbols disposed on the outer circumferential surfaces of the reels 52A to 52E. In FIG. 9, too, the "first reel" means the reel 52A; the "second reel" means the reel 52B; the "third reel" means the reel 52C; the "fourth reel" means the reel 52D; and the "fifth reel" means the reel 52E.

The symbol code determination table is defined as a table for defining the symbols on each of the reels 52A to 52E, the arrangement of the symbols, and the appearance probabilities of the symbols. The symbol code determination table defines the probabilities that the symbols on each reel appear in a specific row (for example, the middle row) of the symbol matrix.

Twenty-two symbols including BLANK symbols attached to each of the reels 52A to 52E form a symbol sequence. As will be described later, the 22 symbols disposed on the reel 52A are referred to as the first symbol sequence; the 22 symbols disposed on the reel 52B are referred to as the second symbol sequence; the 22 symbols disposed on the reel 52C are referred to as the third symbol sequence; the 22 symbols disposed on the reel 52D are referred to as the fourth symbol sequence; and the 22 symbols disposed on the reel 52E are referred to as the fifth symbol sequence.

In the present embodiment, the symbols include seven kinds of symbols except for the BLANK symbol. The seven kinds of the symbols are RED7, BLUE7, 1BAR, 2BAR, 3BAR, BONUS, and DOUBLE.

A BLANK symbol forms a blank space between two adjacent upper and lower symbols. A RED7 symbol is a red-colored "7" symbol. A BLUE7 symbol is a blue-colored "7" symbol. A 1BAR symbol is a symbol including a character string of "BAR". A 2BAR symbol is a symbol including two character strings of "BAR". A 3BAR symbol is a symbol including three character strings of "BAR". When a specific combination of symbols is complete along a payline, winning is determined and payout corresponding to the prize is given to the player.

A BONUS symbol is a scatter symbol. As to the scatter symbol, winning or losing is determined depending on the number of scatter symbols appearing in the display window 56, regardless of paylines. Specifically, in the base game mode, if five or more BONUS symbols appear at rearrangement of the symbols, the game mode changes to the feature game mode (roulette game mode). That is to say, five or more BONUS symbols function as trigger symbols in the base game mode. In the free game mode, five or more BONUS symbols appearing at rearrangement of the symbols retrigger a game mode change. That is to say, five or more BONUS symbols function as retrigger symbols. When a game mode change is retriggered, a dividend for each of the BONUS symbols is disbursed as a payout before entering the roulette game mode again.

The DOUBLE symbol functions as a wild symbol that can replace a symbol other than the scatter symbol with a different symbol. Replacing a symbol with a different symbol may complete a specific combination to win. Furthermore, if the winning is determined with one DOUBLE symbol included in a payline, the dividend for the payline should be doubled. If the winning is determined with two DOUBLE symbols included in a payline, the dividend for the payline should be quadrupled.

As illustrated in FIG. 9, in each of the first to the fifth symbol sequences, the symbols are assigned code numbers of 0 to 21. For example, the first symbol BONUS in the first symbol sequence is assigned a code "00". The second symbol BLANK in the first symbol sequence is assigned a code "01". The eleventh symbol BLUE7 in the first symbol sequence is assigned a code "10".

As illustrated in FIG. 9, three consecutive symbols in each symbol sequence are shown in the display window 56 of the symbol display unit 40, so that a symbol matrix of three rows and five columns is formed in the display window 56.

Each time one of the BET button 74 to 78 or the START button 79 is pressed, the reels 52A to 52E with symbols start spinning to show the symbols in the display window 56 in such a manner that the symbols are vertically scrolling in the display window 56. After a predetermined time, the scrolling of the symbols is stopped to rearrange the symbols to form a symbol matrix in the display window 56.

<<State Transition During Games>>

Figure 10:
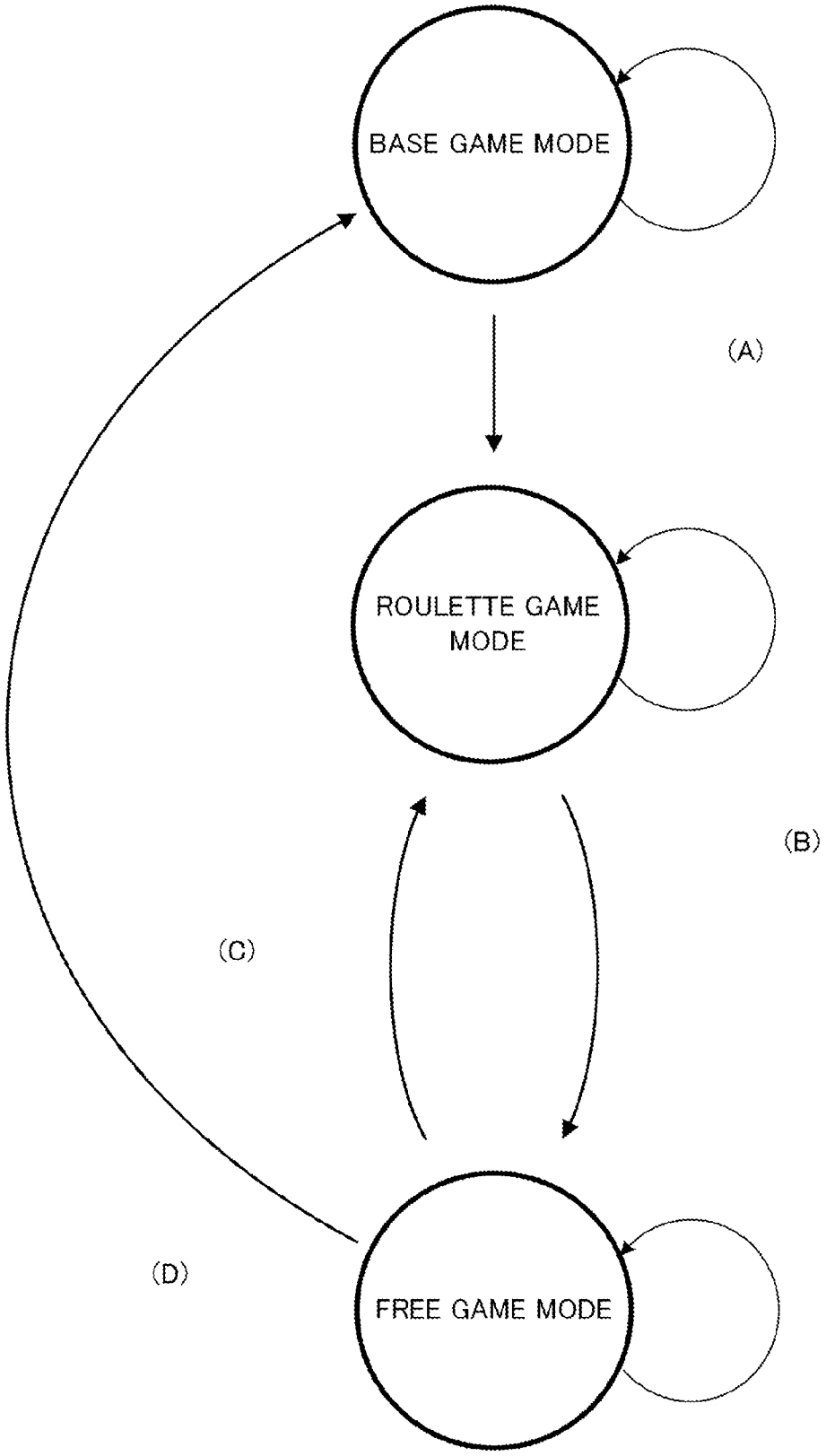
FIG. 10 is a drawing illustrating state transitions in the gaming machine.

FIG. 10 is a state transition diagram of the slot machine 10.

The gaming machine 10 has a base game mode, a roulette game mode, and a free game mode. The roulette game mode and the free game mode are occasionally referred to as feature game mode. The base game mode offers at least one base game of a unit game. The roulette game mode offers a predetermined number of roulette games of unit games. The free game mode offers a predetermined number of free games of unit games.

The gaming machine 10 offers games in the base game mode as default. If five or more BONUS symbols appear at rearrangement of the symbols in the base game mode, the game mode changes to the feature game mode (roulette game mode)(FIG. 10 (A)). That is to say, the five BONUS symbols in the base game mode function as trigger symbols. Appearance of five or more BONUS symbols at symbol rearrangement in the base game mode is a trigger event.

After entering the roulette game mode from the base game mode, a roulette game of a unit game can be repeated until the lottery count reaches the maximum. The maximum number of lotteries is determined by the number of BONUS symbols appearing in the base game mode. Repeating the roulette game until the lottery count reaches the maximum satisfies the requirement to exit the roulette game mode. When the requirement to exit the roulette game mode is satisfied, the game mode changes from the roulette game mode to the free game mode (FIG. 10 (B)).

The result of a roulette game determines a dividend in free games or winning a jackpot. These will be described later.

After entering the free game mode from the roulette game mode, a free game of a unit game can be repeated until the game count reaches the maximum. The maximum number of games is basically seven, but may be increased depending on the game result of a free game. Repeating the free game until the maximum number of games is reached satisfies the requirement to exit the free game mode. When the requirement to exit the free game mode is satisfied, the game mode returns from the free game mode to the base game mode (FIG. 10 (D)). As mentioned, the maximum number of games increases depending on the game result of a free game; the maximum number of games may be different every time the game mode enters the free game mode, so that the free game mode attains variation.

In the free game mode, if five or more BONUS symbols appear at rearrangement of the symbols, the game mode returns to the roulette game mode (FIG. 10 (C)). That is to say, five BONUS symbols in the free game mode function as retrigger symbols. In the free game mode, appearance of five or more BONUS symbols at rearrangement of the symbols is a retrigger event.

A free game is a game that allows a unit game same as the base game to be repeated without spending game media such as medals. Depending on the result of a free game, a payout based on the dividend in the free game is disbursed. These will be described later.

<<Control Processing>>

Next, with reference to FIGS. 11 to 29, a control program to be executed by a gaming machine 10 is described.

<Main Control Processing>

Figure 11:
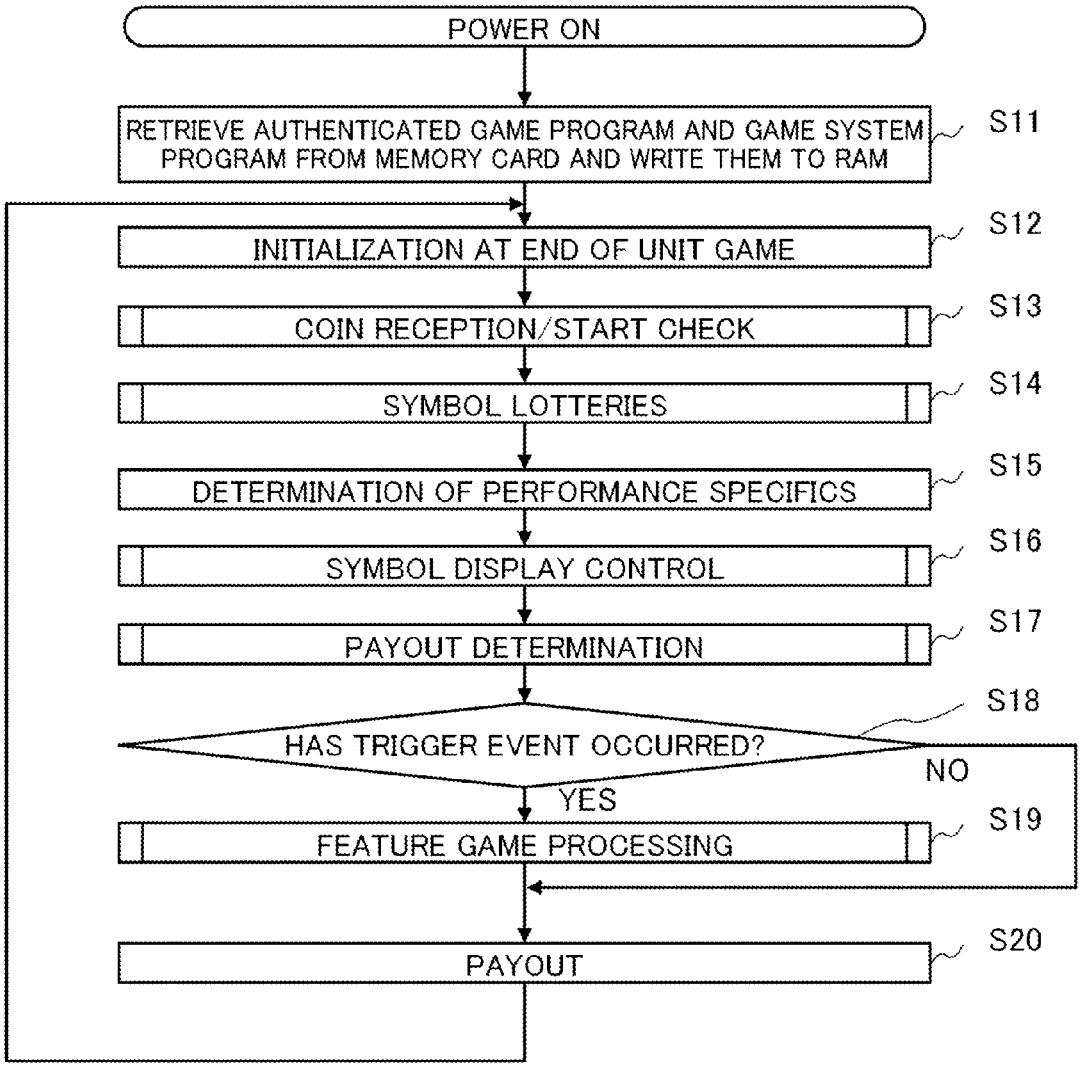
FIG. 11 is a flowchart of main control processing in the gaming machine.

FIG. 11 is a flowchart of main control processing in a gaming machine 10 according to an embodiment of the present invention.

When the gaming machine 10 is powered on, the main CPU 222 retrieves an authenticated game program and an authenticated game system program from the memory card 210 via the game board 200 and writes them to the RAM 226 (Step S11). Thus, the base game mode is started.

Next, the main CPU 222 executes initialization at the end of single game (Step S12). The single game means a single unit game. For example, this step clears data which is no longer necessary after the end of every single unit game, such as the number of bets and the symbols determined by a lottery, from the working area of the RAM 226.

Next, the main CPU 222 executes coin reception/start check (Step S13), which will be described later with reference to FIG. 12. At this step, the main CPU 222 checks for input with a BET button or the START button 79.

Next, the main CPU 222 executes symbol lotteries (Step S14), which will be described later with reference to FIG. 13. At this step, the main CPU 222 determines the symbols to be stopped based on random values for symbol determination.

Next, the presentation performance control module 312 run by the main CPU 222 determines the performance specifics (Step S15). The main CPU 222 extracts a random value for performance determination to determine one of a plurality of predefined performances by lottery, and executes the determined performance at the time specified therefor.

For example, the main CPU 222 controls the video display unit 110 to display a video for the performance, the speakers 112 to output audio, and the lamp 114 to light, and further controls these devices to apply effects to the performance. If a feature game trigger is complete, or if the player selects free games thereafter, the main CPU 222 executes further performance such as playing a special video on the video display unit 110.

Next, the main CPU 222 executes symbol display control (Step S16), which will be described later with reference to FIG. 14. At this step, the main CPU 222 starts scrolling the symbol sequences on the reels and stops the symbols to be stopped determined in the symbol lotteries at Step S14 at predetermined positions.

Next, the main CPU 222 executes payout determination (Step S17), which will be described later with reference to FIG. 15. At this step, in the case of the base game mode, the main CPU 222 determines the number of payouts based on the combination of symbols appearing on each payline with reference to the payout table (FIG. 7) and stores the number of payouts to a payout count storage area (payout counter) provided in the RAM 226. In the case of the free game mode, the main CPU 222 determines the number of payouts based on a dividend different from the ones in base games.

Next, the main CPU 222 determines whether a trigger event has occurred (Step S18). In the present embodiment, if the rearranged symbols include five or more BONUS symbols (trigger symbols), a trigger event occurs. When the main CPU 222 determines that a trigger event has occurred, it executes feature game processing (Step S19), which will be described later with reference to FIG. 16.

Next, after Step S19 or if the determination at Step S18 is that no trigger event has occurred, the main CPU 222 executes payout processing (Step S20). The main CPU 222 adds the value held in the payout count storage area (payout counter) to the value held in a credit count storage area (credit counter 320) provided in the RAM 226. Alternatively, the main CPU 222 may control the driver of the hopper 242 so as to output coins corresponding to the payout counter to the coin tray. Still alternatively, the main CPU 222 may control the driver of the ticket printer 120 so as to issue a ticket with a barcode indicating the record of the payout counter. After this step, the main CPU 222 clears the mode flag and the BONUS symbol value storage area and returns to Step S12.

<Coin Reception/Start Check>

Figure 12:
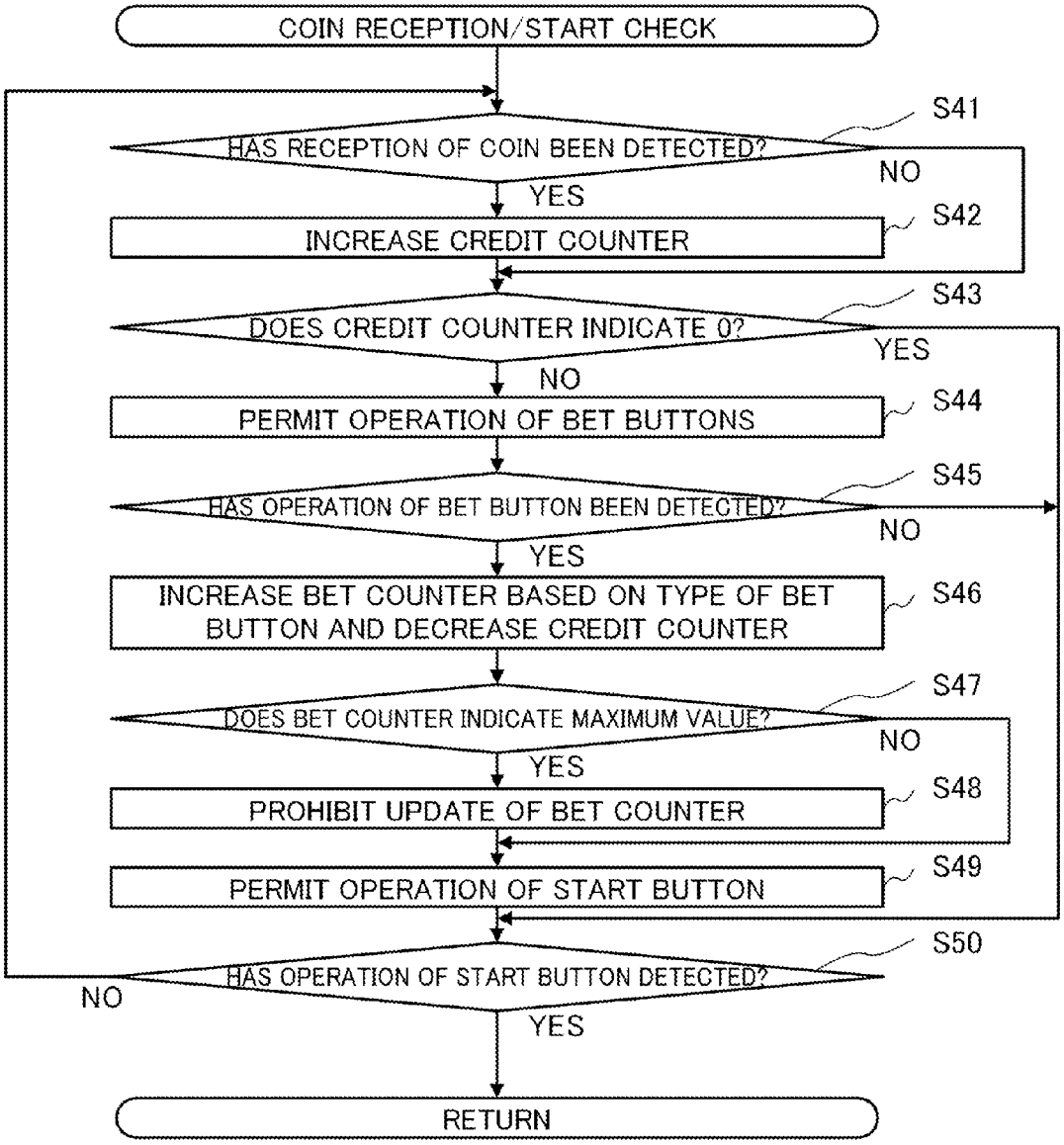
FIG. 12 is a flowchart of coin reception/start check in the gaming machine.

FIG. 12 is a flowchart of coin reception/start check in a gaming machine 10 according to an embodiment of the present invention.

First, the main CPU 222 determines whether the coin counter 232 has detected reception of a coin (Step S41) with the input/credit check module 300 run by the main CPU 222. If the determination is that reception of a coin has been detected, the main CPU 222 adds a value corresponding to the amount of the received coin to the value held in the credit count storage area (credit counter 320) (Step S42). In addition to the coin, the main CPU 222 may determine whether the bill validator 246 has detected reception of a bill, and if the determination is that reception of a bill has been detected, increase the credit counter 320 by a value corresponding to the amount of the bill.

After Step S42 or if determination at Step S41 is that reception of a coin has not been detected, the main CPU 222 determines whether the credit counter 320 indicates 0 (Step S43). If the determination is that the credit counter 320 does not indicate 0, the main CPU 222 permits operation of the BET buttons (Step S44).

Next, the main CPU 222 determines that operation of a BET button has been detected (Step S45). If the main CPU 222 detects a press of a BET button by the player through a BET switch, it adds a value based on the type of the BET button to the value held in a bet count storage area (bet counter) provided in the RAM 226 and decrease the credit counter 320 (Step S46).

Next, the main CPU 222 determines whether the bet counter indicates the maximum value (Step S47). If the determination is that the bet counter indicates the maximum value, the main CPU 222 prohibits update of the bet counter (Step S48). After Step S48 or if the determination at Step S47 is that the bet counter does not indicate the maximum value, the main CPU 222 permits operation of the START button 79 (Step S49).

After Step S49, if the determination at Step S45 is that operation of a BET button has not been detected, or if the determination at Step S43 is that the credit counter 320 indicates 0, the main CPU 222 determines whether operation of the START button 79 has been detected (Step S50). If the determination is that operation of the START button 79 has not been detected, the main CPU 222 returns to Step S41.

If the determination is that operation of the START button 79 has been detected, the main CPU 222 exits the coin reception/start check.

<Symbol Lotteries>

Figure 13:
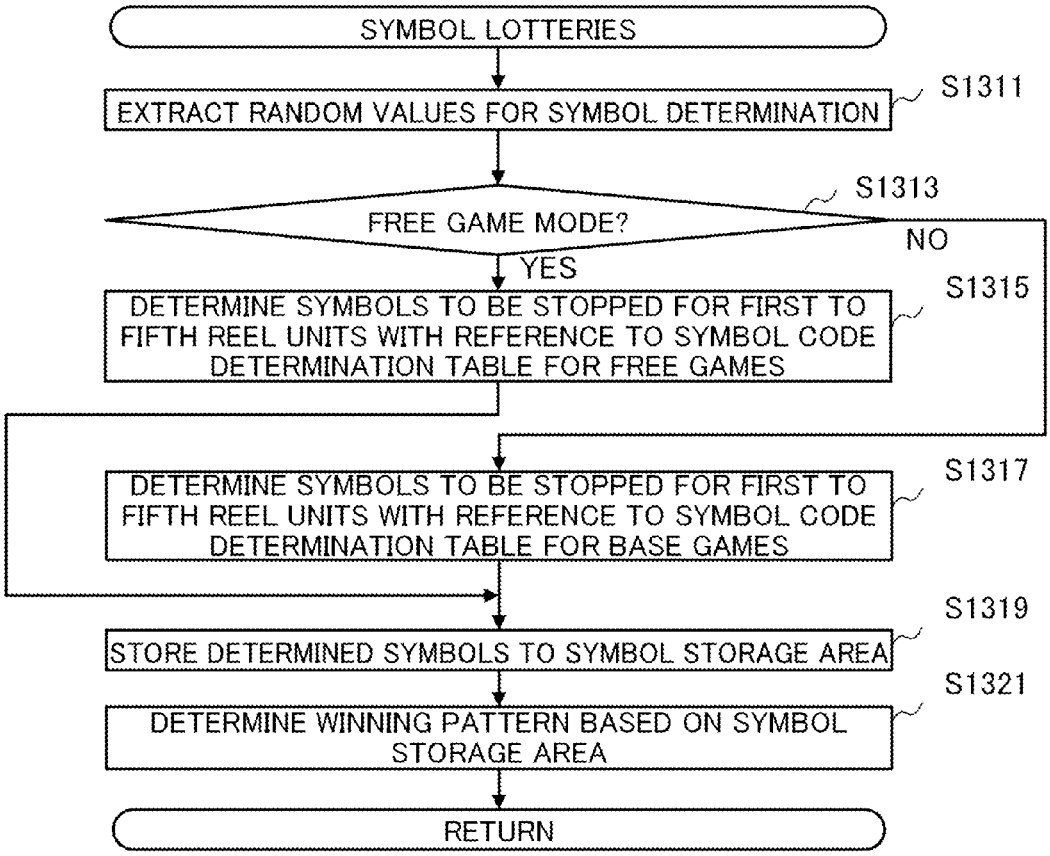
FIG. 13 is a flowchart of symbol lotteries in the gaming machine.

FIG. 13 is a flowchart illustrating symbol lotteries in a gaming machine 10 according to an embodiment of the present invention.

First, the random number generation module 302 run by the main CPU 222 extracts random values for symbol determination (Step S1311).

Next, the main CPU 222 determines whether the game mode is a free game mode (Step S1313). If the determination is that the game mode is a free game mode (YES), the main CPU 222 determines the symbols to be stopped for the reels 52A to 52E with reference to the symbol code determination table for free games (Step S1315).

Contrarily, if the determination at Step S1313 is that the game mode is not the free game mode (NO), the main CPU 222 determines the symbols to be stopped for the reels 52A to 52E with reference to the symbol code determination table for base games (Step S1317).

At Step S1315 or S1317, the main CPU 222 draws a lottery for each of the reels 52A to 52E and determines a symbol to be stopped out of the 22 symbols (code Nos. 00 to 21) in the symbol code determination table (FIG. 9). In the lottery, the probabilities to draw the 22 symbols (code Nos. 00 to 21) accord with the weights in the symbol code determination table.

After Step S1315 or S1317, the main CPU 222 stores the determined symbols to be stopped for the reels to a symbol storage area provided in the RAM 226 (Step S1319). Next, the winning determination module 310 run by the main CPU 222 determines the winning pattern based on the combination of symbols stored in the symbol storage area (Step S1321), with reference to the payout table (FIG. 7). The main CPU 222 determines whether the combinations of symbols on the reels to appear on the paylines match any of the combinations of symbols defined in the payout table and determines the winning pattern. As to the BONUS symbol of the scatter symbol, the main CPU 222 determines whether the number of BONUS symbols to appear in the display window 56 matches one of the numbers of BONUS symbols defined in the payout table, and determines the winning pattern.

<Symbol Display Control>

Figure 14:
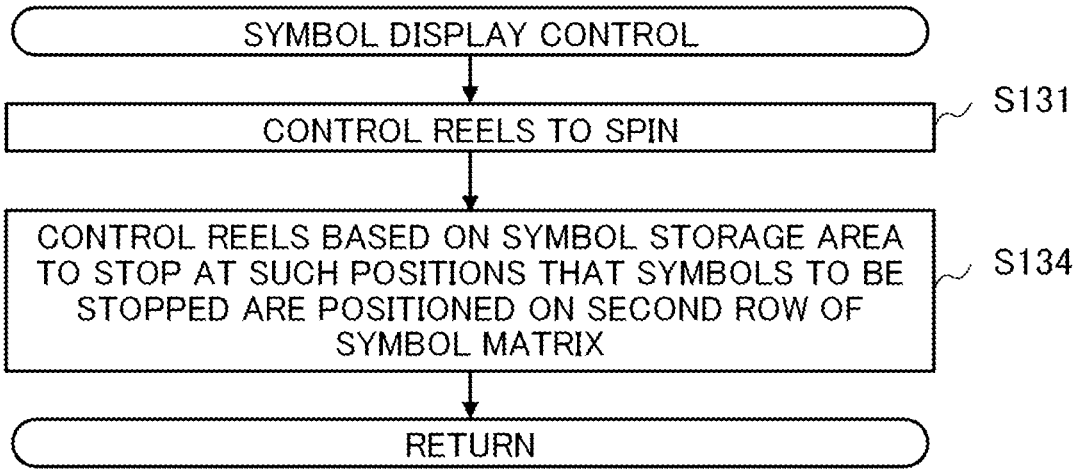
FIG. 14 is a flowchart of symbol display control in the gaming machine.

FIG. 14 is a flowchart of symbol display control in a gaming machine 10 according to an embodiment of the present invention.

First, the reel control module 308 run by the main CPU 222 sends a spin control signal to the reel assembly 50. The reel drivers 264 of the reels 52A to 52E supply power to the reel motors 272 to spin the reels 52A to 52E. The reels 52A to 52E spin at a predetermined speed so that the symbol sequences on the reels 52A to 52E scroll in the display window 56 of the symbol display unit 40 (Step S131).

Next, the reel control module 308 run by the main CPU 222 controls the reels to stop (Step S134). The spin control signal includes information on the stop positions of the reels 52A to 52E. The information on the stop positions can be obtained from the symbols to be stopped for the reels held in the symbol storage area. The reel drivers 264 of the reels 52A to 52E control the reel motors 272 to stop the reels 52A to 52E at the positions indicated by the spin control signal. In this way, the reel control module 308 controls the reel motors 272 made of stepping motors to stop at desired positions; the scrolling symbol sequences are stopped at such positions that the symbols to be stopped are positioned on the middle row of the symbol matrix formed in the display window 56.

Through the symbol display control illustrated in FIG. 14, symbols are rearranged in the display window 56. That is to say, the symbols rearranged in the display window 56 constitute the symbol matrix formed in the display window 56.

<Payout Determination>

Figure 15:
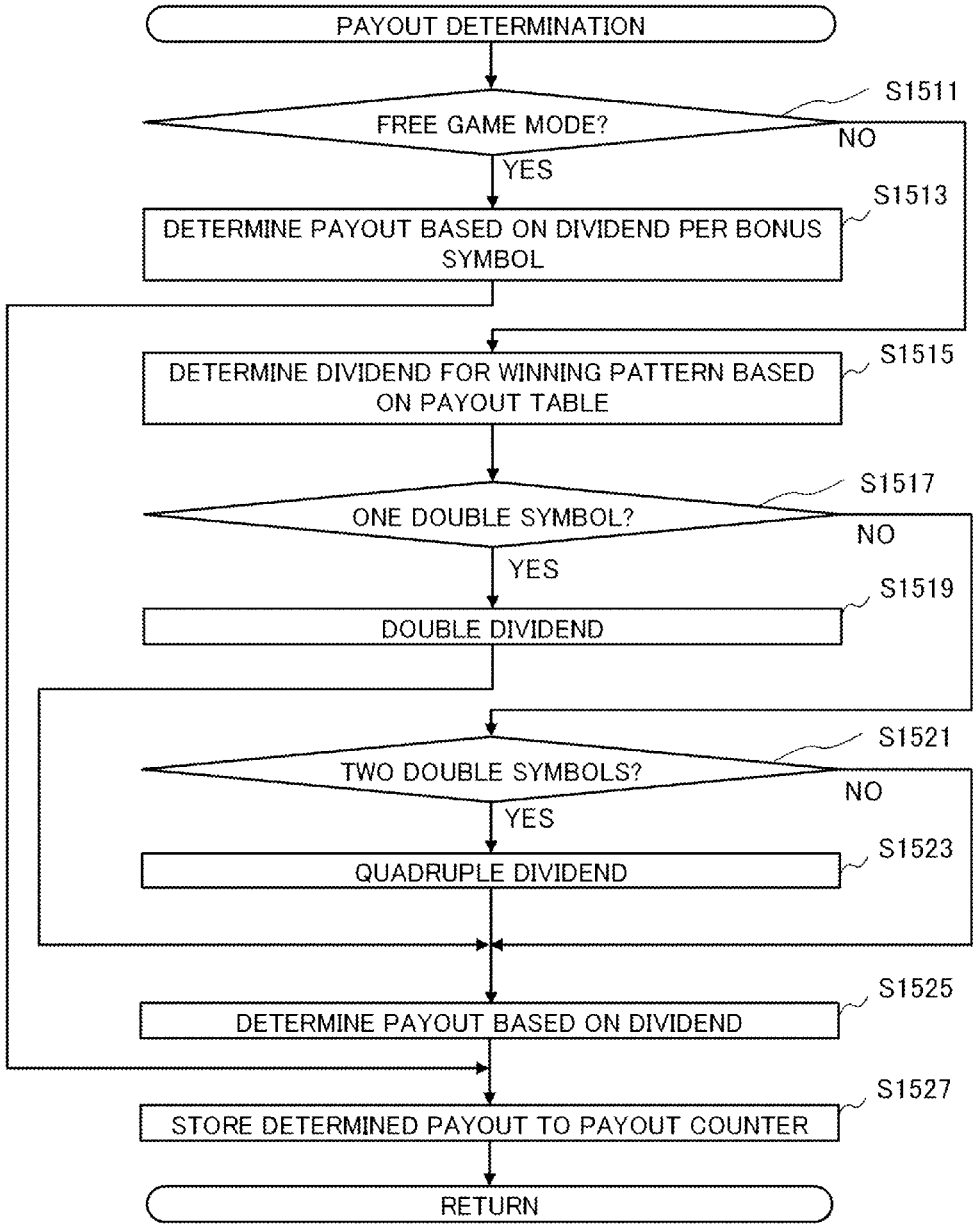
FIG. 15 is a flowchart of payout determination in the gaming machine.

FIG. 15 is a flowchart of payout determination in a gaming machine 10 according to an embodiment of the present invention.

First, the main CPU 222 determines whether the game mode is a free game mode (Step S1511).

If the determination is that the game mode is a free game mode (YES), the main CPU 222 determines the number of payouts based on the dividend per BONUS symbol (Step S1513). The dividend per BONUS symbol is calculated at Step S1919 in FIG. 19.

If the determination is that the game mode is not a free game mode (NO), the main CPU 222 determines a dividend for the winning pattern based on the payout table (Step S1515).

Next, the main CPU 222 determines whether the winning is determined with a payline including one DOUBLE symbol (Step S1517). If the determination is that the winning is determined with a payline including one DOUBLE symbol (YES), the main CPU 222 doubles the dividend (Step S1519).

If the determination is that the winning is not determined with a payline including one DOUBLE symbol (NO), the main CPU 222 determines whether the winning is determined with a payline including two DOUBLE symbols (Step S1521).

If the determination is that the winning is determined with a payline including two DOUBLE symbols (YES), the main CPU 222 quadruples the dividend (Step S1523).

After Step S1519 or S1523, or if the determination at Step S1521 is that the winning is not determined with a payline including two DOUBLE symbols (NO), the main CPU 222 determines the number of payouts based on the dividend (Step S1525). Next, the main CPU 222 stores the determined number of payouts to a payout counter (Step S1527) and exits this subroutine.

<Feature Game Processing>

Figure 16:
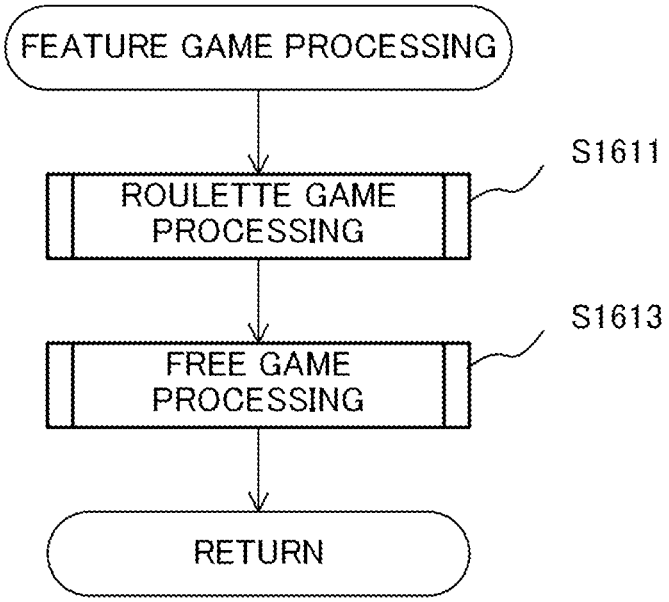
FIG. 16 is a flowchart of feature game processing.

FIG. 16 is a flowchart of feature game processing in a gaming machine 10 according to an embodiment of the present invention. The feature game processing is invoked and executed at Step S19 in FIG. 11. The feature game processing consists of roulette game processing illustrated in FIG. 17 and free game processing illustrated in FIG. 28.

First, the main CPU 222 invokes and executes the roulette game processing illustrated in FIG. 17 (Step S1611). Execution of the roulette game processing changes the game mode from the base game mode to the roulette game mode.

Figure 28:
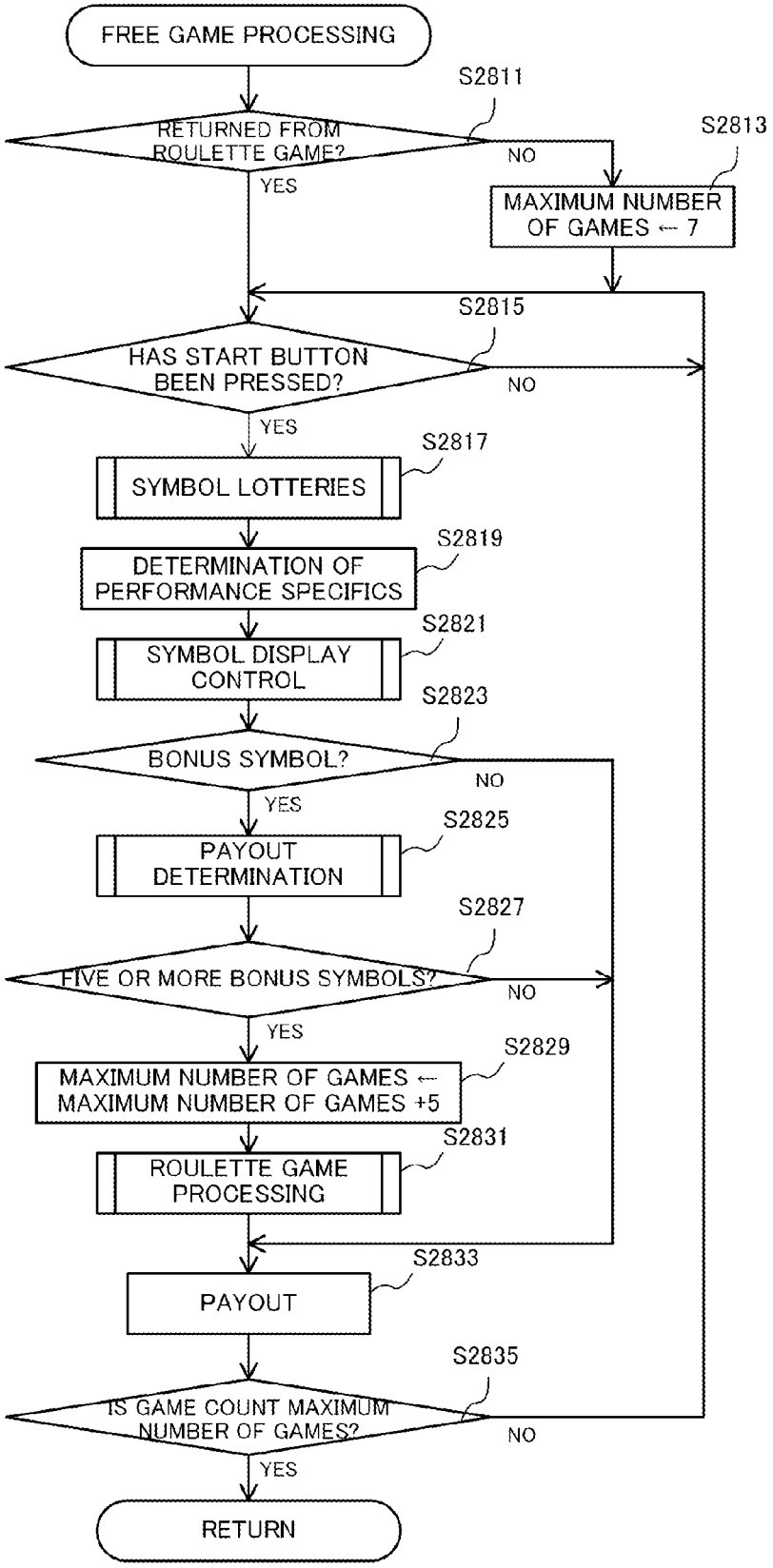
FIG. 28 is a flowchart illustrating free game processing.

Next, the main CPU 222 invokes and executes free game processing illustrated in FIG. 28 (Step S1613), and exits this subroutine. Execution of the free game processing changes the game mode from the roulette game mode to the free game mode. Exit from this subroutine returns the game mode from the free game mode to the base game mode.

<Roulette Game Processing>

FIGS. 17 to 19 are a flowchart of the roulette game processing in a gaming machine 10 according to an embodiment of the present invention. Execution of this processing changes the game mode from the base game mode to the roulette game mode.

First, the main CPU 222 displays a roulette image shown in FIG. 29 on the video display unit 110 (Step S1711). As shown in FIG. 29, the roulette image is formed of a cell for MINOR JACKPOT, a cell for MAJOR JACKPOT, two cells for a dividend of 15, two cells for a dividend of 20, two cells for a dividend of 25, one cell for a dividend of 30, one cell for a dividend of 50, three cells for a dividend of 100, one cell for a dividend of 150, one cell for a dividend of 250, and one cell for a dividend of 500, which are disposed to be adjacent to one another along the outer rim and displayed on the video display unit 110. That is to say, the roulette consists of two kinds of progressive jackpot cells and 14 cells for dividends. As shown in FIG. 29, each of the 16 cells is assigned a cell number (one of 0 to 15). In FIG. 29, the cell numbers are indicated in parentheses. The actual roulette image does not show the cell numbers and the player cannot see the cell numbers; however, the roulette image in FIG. 29 is indicated with the cell numbers in order to clearly distinguish the cells.

As illustrated in FIG. 27, each cell number (one of 0 to 15) is assigned a dividend. The cell No. 0 is assigned MAJOR JACKPOT. The cell No. 1 is assigned a dividend of 25; the cell No. 2 is assigned a dividend of 100; the cell No. 3 is assigned a dividend of 30; the cell No. 4 is assigned a dividend of 250; the cell No. 5 is assigned a dividend of 20; the cell No. 6 is assigned a dividend of 100; the cell No. 7 is assigned a dividend of 50; the cell No. 8 is assigned MINOR JACKPOT; the cell No. 9 is assigned a dividend of 25; the cell No. 10 is assigned a dividend of 100; the cell No. 11 is assigned a dividend of 15; the cell No. 12 is assigned a dividend of 500; the cell No. 13 is assigned a dividend of 20; the cell No. 14 is assigned a dividend of 150; and the cell No. 15 is assigned a dividend of 15.

For example, a dividend of 100 is assigned to three cells. Specifically, the cell Nos. 2, 6, and 10 are assigned the same dividend of 100. The present embodiment treats dividends assigned to different numbered cells as different dividends even if the values of the dividends are the same. Accordingly, if, for example, later-described Step S1913 in FIG. 19 is performed for a plurality of times and the dividend of 100 for the cell No. 2, the dividend of 100 for the cell No. 6, and the dividend of 100 for the cell No. 10 are selected, all of these dividends, or a dividend of 300 in total, are given to the player.

In the present embodiment, however, the dividend or the progressive jackpot in the same numbered cell is not given to the player twice. For example, in the case where the cell No. 9 is selected in accordance with an extracted random value and the dividend of 25 is given to the player, if a subsequently extracted random value indicates the cell No. 9 again, the dividend 25 for the cell No. 9 is not given to the player. Accordingly, if some cell number is selected in accordance with an extracted random value, the cell number is excluded so that one of the other cell numbers will be selected.

Next, the main CPU 222 resets the number of lotteries (Step S1713). That is to say, the main CPU 222 clears the data on the number of roulette lotteries held in the RAM 226.

Next, the main CPU 222 determines whether the game mode has been changed from a free game mode (S1715). If the determination is that the game mode has not been changed from a free game mode (NO), meaning that the game mode has been changed from a base game mode to the roulette game mode, the main CPU 222 resets the selected sell numbers (Step S1717). That is to say, the main CPU 222 clears the selected cell numbers held in the RAM 226.

The cell number is determined by later-described Step S1913 in FIG. 19. Through the determination at Step S1913, one of the 14 cell numbers is selected. The determined cell number is stored in the RAM 226 as a selected cell number. Step S1913 in FIG. 19 is repeated for a plurality of times to determine multiple cell numbers, not only one cell number. When multiple cell numbers are determined, they can be stored in the RAM 226 as selected cell numbers. Selection of cell numbers will be described later.

Next, the main CPU 222 resets the count of selected cell numbers (Step S1719). That is to say, the main CPU 222 clears the count of selected cell numbers stored in the RAM 226. The count of selected cell numbers corresponds to the number of all cell numbers selected at Step S1913 in FIG. 19.

Next, the main CPU 222 resets the dividend (Step S1721). That is to say, the main CPU 222 clears the dividend stored in the RAM 226. This dividend corresponds to the dividend (total dividend) added at Step S1919 in FIG. 19.

Next, the main CPU 222 resets the progressive jackpot(s) (Step S1722). That is to say, the main CPU 222 clears the progressive jackpot(s) stored in the RAM 226, which correspond to the progressive jackpot(s) determined at Step S1821 in FIG. 18.

In this way, when the game mode enters the roulette game mode from a base game mode, the selected cell numbers, the count of selected cell numbers, the dividend (total dividend), and the progressive jackpot(s) are reset. In contrast, when the game mode enters the roulette game mode from a free game mode, these are not reset but maintained. Accordingly, in the roulette game mode changed from a free game mode, the dividend (total dividend) may further increase. Furthermore, since the selected cell numbers have been stored, the same cell numbers will not be doubly selected in the roulette game mode changed from the free game mode. In similar, since the selected progressive jackpot has been stored, the same progressive jackpot will not be doubly selected in the roulette game mode changed from a free game mode.

Accordingly, when the game mode first enters a roulette game mode from a base game mode, the previous dividend is reset and then a dividend associated with a cell number is determined. Thereafter, the game mode is changed from the roulette game mode to a free game mode. If the game mode returns to the roulette game mode, the dividend determined in the previous roulette game mode is not reset and, in response to selection of a cell number, a dividend associated with the cell number is added to the previous dividend. In this way, if the game mode returns to the roulette game mode from a free game mode, the dividend can be more increased. When the game mode returns from the roulette game mode to the free game mode again, the payout is determined in accordance with the more increased dividend. Thus, if the game mode returns to the roulette game mode, the payout can be more increased. The dividend at this stage is a dividend per BONUS symbol. Accordingly, the payout per unit game in the free game mode will be a value obtained by multiplying the number of BONUS symbols appearing at rearrangement by the dividend per BONUS symbol.

If the determination at the foregoing Step S1715 is that the game mode has been changed from a free game mode (YES) or after Step S1721, the main CPU 222 determines a maximum number of lotteries with reference to the maximum lottery determination table shown in FIG. 20 (Step S1723). The main CPU 222 stores the maximum number of lotteries in the RAM.

The Step S1723 is executed in both cases where the game mode has been changed from a base game mode and a free game mode. In the case of change from a base game mode, the maximum number of lotteries is determined in accordance with the number of BONUS symbols (trigger symbols) appearing at Step S16 in FIG. 11. In the case of change from a free game mode, the maximum number of lotteries is determined in accordance with the number of BONUS symbols (retrigger symbols) appearing at Step S2821 in FIG. 28.

FIG. 20 is a table defining association relations of the numbers of BONUS symbols and the numbers of lotteries. The number of BONUS symbols means the number of BONUS symbols appearing in the display window 56 after rearrangement of the symbols in a base game. The number of lotteries means the maximum number of lotteries allowed as roulette games. For example, if five BONUS symbols appear in a base game, only one lottery can be drawn as a roulette game. If eight BONUS symbols appear in a base game, five lotteries can be drawn as roulette games. The main CPU 222 stores the maximum number of lotteries in the RAM 226. It should be noted that the association relations of the maximum numbers of lotteries and the numbers of BONUS symbols are not limited to the values in the table shown in FIG. 20 but can be changed as necessary.

Next, the main CPU 222 determines whether the START button 79 has been pressed by a player (Step S1811). If the determination is that the START button 79 has not been pressed by a player (NO), the main CPU 222 returns to Step S1811. This means that the main CPU 222 stands by until the START button 79 is pressed by a player.

If the determination is that the START button 79 has been pressed by a player (YES), the main CPU 222 determines whether two progressive jackpots have been won (Step S1813), meaning that the CPU 222 determines whether both of Major Progressive Jackpot and Minor Progressive Jackpot have been won.

If the determination at Step S1813 is that either one or neither of the two progressive jackpots has been won (NO), the main CPU 222 performs moving cell display (Step S1815).

Step S1815 displays a spinning roulette. As illustrated in FIG. 29, the roulette consists of 16 cells: two cells for two kinds of progressive jackpots and 14 cells for dividends.

First, the main CPU 222 shows one cell brightly. That is to say, it shows an image as if the cell is virtually illuminated with backlight. Hereinafter, this operation is referred to as showing brightly. After a predetermined period, the main CPU 222 stops showing the cell brightly. That is to say, it shows an image as if the backlight is turned off. Hereinafter, this operation is referred to as showing darkly.

Subsequently, the main CPU 222 shows the next cell brightly, and after a predetermined period, shows the cell darkly. Then, it shows the next cell to the next brightly, and after another predetermined period, shows the cell darkly. Sequentially performing this operation one by one to the next cells can show an image as if a bright cell goes around the 16 cells. This operation is continued until the later-described Step S1829 or S1917.

This step displays a roulette game image in which a brightly shown cell moves along from "MAJOR JACKPOT" in the cell No. 0, the dividend "25" in the cell No. 1, the dividend "100" in the cell No. 2, . . . to the dividend "15" in the cell No. 15 repetitively.

Next, the main CPU 222 extracts a random value for determining a progressive jackpot (Step S1817). The main CPU 222 stores the extracted random value in the RAM 226.

Next, the main CPU 222 invokes and executes the later-described creation of a progressive determination table illustrated in FIG. 21 (Step S1819).

Next, the main CPU 222 determines the progressive jackpot based on the random value extracted at Step S1817 with reference to the created progressive determination table (Step S1821). This step determines winning or not (losing) a progressive jackpot. That is to say, winning only Major Progressive Jackpot, winning only Minor Progressive Jackpot, or losing both of Major Progressive Jackpot and Minor Progressive Jackpot is determined. The main CPU 222 stores the kind of the progressive jackpot or a loss in the RAM 226.

Next, the main CPU 222 stands by until a predetermined time passes (Step S1823).

Next, the main CPU 222 determines whether winning a progressive jackpot has been determined at Step S1821 (Step S1825). This determination is to determine whether a progressive jackpot has been won with the random value extracted at Step S1817 at this time. This determination is not to determine whether any progressive jackpot has been won with the random values previously extracted at Step S1817. Accordingly, even if a progressive jackpot has been won in the past, the determination at Step S1825 may not determine that a progressive jackpot has been won.

If the determination is that a progressive jackpot has been won (YES), the main CPU 222 determines whether the progressive jackpot won this time is an already selected progressive jackpot (Step S1827).

If the determination is that the progressive jackpot won this time is not an already selected progressive jackpot (NO), the main CPU 222 stops showing the moving cell in accordance with the lottery result (Step S1829). That is to say, it terminates the display of spinning roulette. As a result, if Major Progressive Jackpot is won at Step S1821, the brightly shown cell is stopped at the cell of MAJOR JACKPOT; if Minor Progressive Jackpot is won, the brightly shown cell is stopped at the cell of MINOR JACKPOT.

Next, the main CPU 222 disburses a dividend associated with the drawn progressive jackpot as payout (Step S1831) and returns to Step S1811.

If the determination at Step S1827 is that the progressive jackpot drawn this time is an already selected progressive jackpot (YES), the main CPU 222 returns to Step S1815.

Returning to Step S1815 urges the main CPU 222 to extract a random value for determining a progressive jackpot again at Step S1817 and determine the progressive jackpot again at Step S1821. The second determination of progressive jackpot may result in winning a progressive jackpot. Accordingly, even if Major Progressive Jackpot has already been won, Minor Progressive Jackpot may be won. In similar, even if Minor Progressive Jackpot has already been won, Major Progressive Jackpot may be drawn. This routine allows winning both of Major Progressive Jackpot and Minor Progressive Jackpot.

If the determination at Step S1825 is that no progressive jackpot has been drawn, the main CPU 222 extracts a random value for dividend determination (Step S1911). The main CPU 222 stores the random value for dividend determination in the RAM 226.

Next, the main CPU 222 determines the cell number (dividend) with the extracted random value with reference to the later-described dividend determination table shown in FIG. 27 (Step S1913). The main CPU 222 stores the determined cell number (dividend) in the RAM 226. FIG. 27 is a dividend determination table defining association relations of cell numbers and the dividends and weights for the cell numbers. The weight associated with a dividend in the dividend determination table and the denominator determines the probability of winning the dividend. For example, the probability of winning the dividend "15" in the cell No. 11 is 13/100.

The cell numbers in the dividend determination table shown in FIG. 27 are numbers for identifying the 16 cells in the roulette image shown in FIG. 29. Step S1913 is to determine a cell number. Step S1913 determines a cell number and determines a dividend associated with the cell number.

Next, the main CPU 222 determines whether the determined cell number is an already selected cell number (Step S1915).

Next, if the determination is that the determined cell number is an already selected cell number (YES), the main CPU 222 returns to Step S1911. Returning to Step S1911 leads to performing Step S1911 to extract a random value to determine a dividend and Step S1913 to determine a cell number again. If the determined cell number is an already selected cell number, a cell number different from already selected cell numbers can be selected, avoid double selection of a cell number.

If a cell number is selected twice, the above-described example performs another determination of cell number to avoid double selection of the cell number. However, the method is not limited to this; the method may create another dividend determination table excluding already selected cell numbers and determine a cell number.

If the determination at Step S1915 is that the determined cell number is not an already selected cell number (NO), the main CPU 222 controls the display so that the brightly shown cell will stop at the cell number determined at Step S1913 (Step S1917). The roulette display is terminated at this Step S1917.

Next, the main CPU 222 adds a dividend associated with the cell number determined at Step S1913 (Step S1919). The main CPU 222 adds a value of the dividend associated with the cell number determined this time to the value of the dividend stored in the RAM 226 and stores the result in the RAM 226. In the case where a plurality of cell numbers are selected, a dividend associated with each of the plurality of cell numbers is added to increase the dividend; this approach can increase the payout to be given to the player as selection of a cell number is repeated.

The dividend added at Step S1919 is the dividend per BONUS symbol. This dividend per BONUS symbol is a dividend to be provided to each BONUS symbol in the case where BONUS symbols appear in the display window in a later-described free game.

Next, the main CPU 222 adds 1 to the count of lotteries (Step S1921). That is to say, the main CPU 222 adds 1 to the count of lotteries stored in the RAM 226.

Next, the main CPU 222 adds 1 to the count of selected cell numbers (Step S1923). That is to say, the main CPU 222 adds 1 to the count of selected cell numbers stored in the RAM 226.

Next, the main CPU 222 determines whether all the cell numbers have been selected (Step S1925). That is to say, the main CPU 222 determines whether the count of selected cell numbers stored in the RAM 226 is the number of all the cells (14).

If the determination at Step S1925 is that all the cell numbers have been selected (YES), the main CPU 222 determines whether all the progressive jackpots have been selected (Step S1927). If the determination is that all the progressive jackpots have not been selected (NO), the main CPU 222 returns to Step S1811. As a result, even though all the cell numbers have been selected, if all progressive jackpots have not been selected, a progressive jackpot can be won. That is to say, if neither Major Progressive Jackpot nor Minor Progressive Jackpot has been won, and if either one of these has been won, the possibility to win a progressive jackpot is generated.

If the determination at Step S1925 is that all the cell numbers have not been selected (NO), or if the determination at Step S1927 is that all the progressive jackpots have been selected (YES), the main CPU 222 determines whether the current count of lotteries is the maximum number of lotteries (Step S1929).

If the determination at Step S1929 is that the current count of lotteries is not the maximum number of lotteries (NO), the main CPU 222 returns to Step S1811. As a result, the roulette game mode is continued.

If the determination at Step S1929 is that the current count of lotteries is the maximum number of lotteries (YES), the main CPU 222 exits this subroutine. As a result, the game mode is changed from the roulette game mode to a free game mode, free games are started.

<Creation of Progressive Determination Table>

Figure 21:
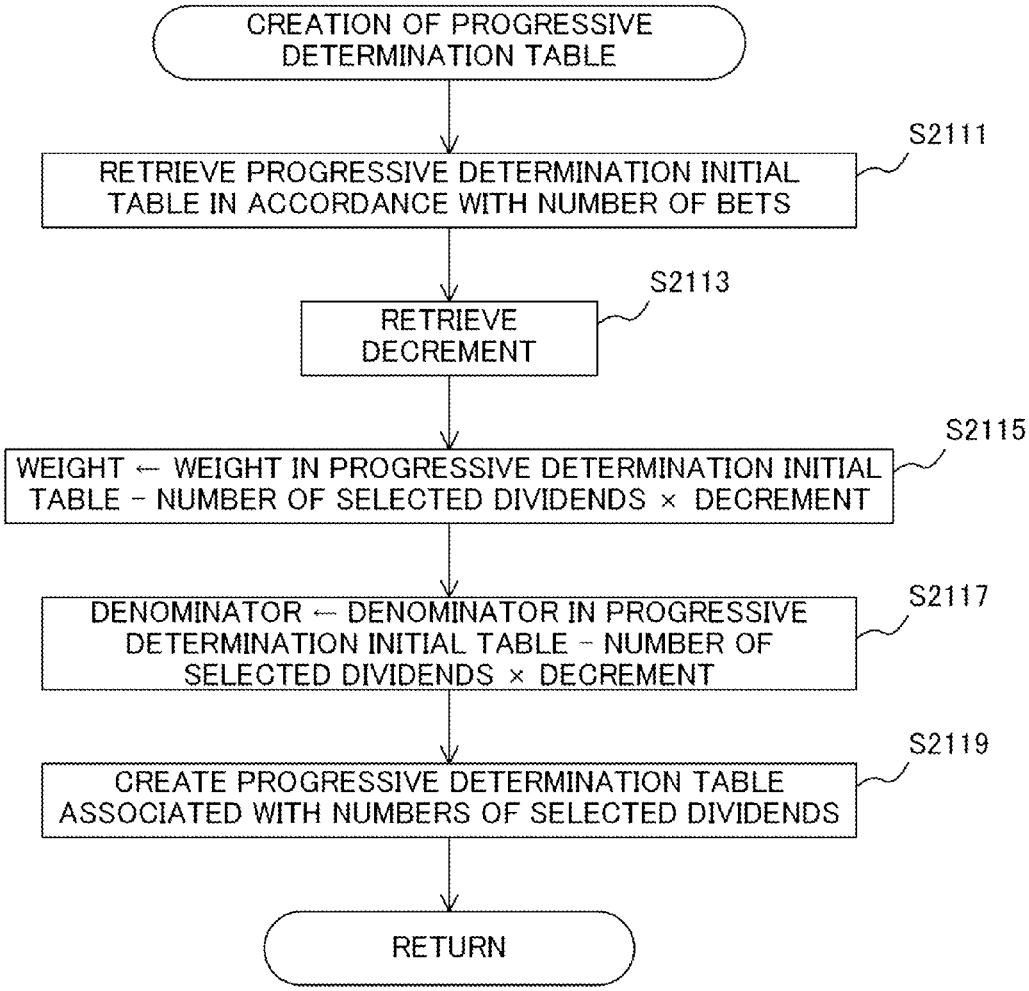
FIG. 21 is a flowchart of creation of a progressive determination table.

FIG. 21 is a flowchart of creating a progressive determination table.

First, the main CPU 222 retrieves a progressive determination initial table illustrated in FIG. 22 in accordance with the number of bets (Step S2111).

FIG. 22 is a table illustrating a progressive determination initial table. In the progressive determination initial table in FIG. 22, each "bet per line" indicates a dividend per payline. Each "dividend" indicates the weight assigned to the dividend for the bet per line. Each "Minor Progressive Jackpot" indicates the weight assigned to Minor Progressive Jackpot for the bet per line. Each "Major Progressive Jackpot" indicates the weight assigned to Major Progressive Jackpot for the bet per line. The weight corresponds to a numerator to be used to calculate a probability. Accordingly, as the value of the weight is greater, the winning probability increases. Each "denominator" is a value to be used to calculate the probability and is a sum of the values of the "dividend", "Minor Progressive Jackpot", and "Major Progressive Jackpot".

After Step S2111, the main CPU 222 retrieves a decrement from the decrement table illustrated in FIG. 23 (Step S2113).

FIG. 23 is a table indicating decrements of weights defined for bet per line values. For example, in the case where the value of the bet per line is 1, the decrement of the weight is 178; in the case where the value of the bet per line is the maximum value of 20, the decrement of the weight is 140. The decrement of weight is defined to be greater as the value of the bet per line is greater.

After Step S2113, the main CPU 222 calculates weights based on the retrieved decrement (Step S2115). That is to say, it calculates each weight with a formula of (weight: the weight in the progressive determination initial table)−(the number of selected dividends×decrement). Here, the "number of selected dividends" means the above-described count of selected cell numbers.

FIG. 24 is a table indicating the weights calculated at Step S2115. FIG. 24 indicates each bet per line value and weights for the first to the fifteenth games of 0 to 14. For any one of the bet per line values, the weight decreases with increase in game count. In the fifteenth game (14), the weight is zero. In FIG. 24, the weight zero means winning without exception.

Next, the main CPU 222 calculates denominators based on the retrieved decrement (Step S2117). That is to say, it calculates each denominator with a formula of (denominator: the denominator in the progressive determination initial table)−(the number of selected dividends×decrement). Here, the "number of selected dividends" also means the above-described count of selected cell numbers.

FIG. 25 is a table indicating the denominators calculated at Step S2117. FIG. 25 indicates each bet per line value and denominators for the first to the fifteenth games of 0 to 14. For any one of the bet per line values, the denominator decreases with increase in game count.

Next, the main CPU 222 creates a progressive determination table associated with the numbers of selected dividends (Step S2119) and exits this subroutine. The main CPU 222 creates the progressive determination table with the weights calculated at Step S2115 and the denominators calculated at Step S2117. The main CPU 222 stores the created progressive determination table in the RAM 226.

FIG. 26 is a table illustrating a progressive determination table created at Step S2119. The "number of selected dividends" in FIG. 26 also means the above-described count of selected cell numbers.

As illustrated in FIG. 26, for each number of selected dividends, an association relation with a dividend, a weight for MINOR JACKPOT, a weight for MAJOR JACKPOT, and a denominator is defined. This progressive determination table enables lotteries depending on the number of selected dividends in roulette games. For example, in the case where the number of selected dividends is 0, the probability to win any one of the 14 dividends (cells) is 2492/2520, the probability to win MINOR JACKPOT is 27/2520, and the probability to win MAJOR JACKPOT is 1/2520. In the case where the number of selected dividends is 5, the probability to win any one of the 14 dividends (cells) is 1602/1630, the probability to win MINOR JACKPOT is 27/1630, and the probability to win MAJOR JACKPOT is 1/1630.

Since the denominator decreases with selection of a dividend as shown in FIG. 26, the probability to win MAJOR JACKPOT or MINOR JACKPOT gradually increases. Creating such a progressive determination table makes it easier to win MAJOR JACKPOT or MINOR JACKPOT after each selection of a dividend.

It should be noted that, as illustrated in FIG. 26, in the case where the number of selected dividends is 14, the weight for the dividend is zero. This means that no lottery for dividend is conducted since all the selectable dividends have been selected; consequently, either MINOR JACKPOT or MAJOR JACKPOT is selected by lottery.

In the above-described example, weights are calculated at Step S2115 and denominators are calculated at Step S2117. The calculations are not limited to this example; the table of weights in FIG. 24 and the table of denominators in FIG. 25 may be prepared and stored in the ROM 224. As a result, the arithmetic processing to calculate the weights and denominators can be omitted to create the progressive determination table speedily.

The progressive determination table in FIG. 26 is a table indicating association relations of the dividend, the weight for MINOR JACKPOT, the weight for MAJOR JACKPOT, and the denominator for all the numbers of selected dividends; however, when one of the numbers of selected dividends is determined, the required is to define the association relation of the dividend, the weight for MINOR JACKPOT, the weight for MAJOR JACKPOT, and the denominator only for the determined number of selected dividends. For example, in the case where the number of selected dividends is 3, required is to define the association relation of the weight for the dividend of 2436, the weight for MINOR JACKPOT of 81, the weight for MAJOR JACKPOT of 3, and the denominator of 2520 for the number of selected dividends of 3. At Step S1821, a progressive jackpot can be determined with the weight for the dividend, the weight for MINOR JACKPOT, the weight for MAJOR JACKPOT, and the denominator determined by the number of selected dividends at that time.

<Dividend Determination Table>

FIG. 27 is a table illustrating a dividend determination table defining association relations of cell numbers with the dividends and the weights for the cell numbers. As described above, the cell numbers are numbers for identifying 16 cells of the roulette image shown in FIG. 29. In FIG. 29, the cell numbers are indicated in the parentheses. The dividends are assigned to the 16 cells. In the present embodiment, the cells include not only dividends but also MINOR JACKPOT and MAJOR JACKPOT. The cell No. 0 is assigned MAJOR JACKPOT and the cell No. 8 is assigned MINOR JACKPOT.

In order to make clear both of the dividends and progressive jackpots associated with cell numbers, FIG. 27 shows MINOR JACKPOT and MAJOR JACKPOT for convenience. The dividend determination table is a table defining the weights to determine dividends; MINOR JACKPOT and MAJOR JACKPOT are not selected using the dividend determination table. For this reason, FIG. 27 indicates the weights of MINOR JACKPOT and MAJOR JACKPOT as 0.

Using the dividend determination table in FIG. 27, one of the 14 cells excluding MINOR JACKPOT and MAJOR JACKPOT (cell Nos. 1 to 7 and 9 to 15) is determined by lottery to determine the dividend associated with the cell. Unlike the tables in FIGS. 24 and 25, the dividend determination table does not depend on the bet and is common to any number of bets.

<<Free Game Processing>>

FIG. 28 is a flowchart illustrating free game processing. In the present embodiment, the paylines and the bet per line at the start of the free game mode are maintained. That is to say, the paylines and the bet per line in the base game mode before entering the free game mode are maintained in the free game mode.

The symbols used in the free game mode can be changed from those used in the base game mode. In this case, the symbols are changed by changing the color of light emitted from the backlight.

First, the main CPU 222 determines whether the current free game mode has been returned from a roulette game mode (Step S2811). As illustrated in FIG. 10, the game mode may change to a roulette game mode during a free game mode and return to the free game mode from the roulette game mode. Step S2811 is to determine whether the current free game mode is the second free game mode returned from a roulette game mode changed from the first free game mode.

If the determination is that the current free game mode is not the free game mode returned from a roulette game mode (NO), meaning the game mode is changed from a base mode game to a roulette game mode and then changed from the roulette game mode to the free game mode, the main CPU 222 sets the maximum number of games at 7 (Step S2813). The main CPU 222 stores the maximum number of games in the RAM 226.

If the determination is that the free game mode is returned from a roulette game mode (YES) or after Step S2813, the main CPU 222 determines whether the START button 79 has been pressed by the player (Step S2815). If the determination is that the START button 79 has not been pressed by the player (NO), the main CPU 222 returns to Step S2811. As a result, the main CPU 222 stands by until the START button 79 is pressed by the player.

If the determination is that the START button 79 has been pressed by the player (YES), the main CPU 222 invokes and executes the subroutine of symbol lotteries illustrated in FIG. 13 (Step S2817).

Next, the main CPU 222 performs determination of specifics of performance (Step S2819). The main CPU 222 extracts a random value for performance determination and determines one of a plurality of predetermined performance specifics by lottery.

Next, the main CPU 222 performs the symbol display control illustrated in FIG. 14 (Step S2821). As a result, the symbols are rearranged.

Next, the main CPU 222 determines whether the symbols rearranged through the symbol display control include any BONUS symbol (Step S2823). Since the BONUS symbol is a scatter symbol as described above, the game result is determined depending on the number of appearing BONUS symbols regardless of paylines.

If the rearranged symbols include one or more BONUS symbols (YES), the main CPU 222 invokes and executes the subroutine of payout determination illustrated in FIG. 15 (Step S2825).

Next, the main CPU 222 determines whether the rearranged symbols include five or more BONUS symbols (Step S2827). If the determination is that the rearranged symbols include five or more BONUS symbols (retrigger symbols) (YES), meaning that the retrigger requirement is satisfied, the main CPU 222 increases the maximum number of games by five (Step S2829). The main CPU 222 stores the maximum number of games in the RAM 226.

Next, the main CPU 222 invokes and executes the subroutine of the roulette game processing illustrated in FIGS. 17 to 19 (Step S2831). This approach enables the game mode to change from the free game mode to a roulette game mode when the retrigger requirement is satisfied. Changing the game mode to a roulette game mode allows selection of an unselected dividend or an unselected progressive jackpot, increasing the benefit for the player.

It should be noted that, even if the roulette game processing is performed at Step S2831, all the dividends may have already been selected and further, all the progressive jackpots may have already been won. In such a case, the roulette game processing results in selection of neither a new dividend nor a new progressive jackpot. Accordingly, if all the dividends have been selected and all the progressive jackpots have been selected, the foregoing Step S2829 merely increases the maximum number of games.

The maximum number of games may have an upper limit. For example, when the maximum number of games is increased at Step S2829 and reaches 99 or more, it may be limited to 99. Providing the upper limit to the maximum number of games prevents providing excessive benefit to the player.

If the determination at Step S2823 is that the symbols rearranged by the symbol display control do not include any BONUS symbol (NO), if the determination at Step S2827 is that the rearranged symbols do not include five or more BONUS symbols (NO), or after Step S2831, the main CPU 222 executes payout (Step S2833). It determines the number of payouts based on the number of BONUS symbols appearing in the display window 56 and disburses it as payout.

As described above, the dividend for each BONUS symbol is calculated at Step S1919. If one or more BONUS symbols appear in the display window through Step S2821, the value obtained by multiplying the dividend per BONUS symbol by the number of appearing BONUS symbols is disbursed as payout at Step S2833. Accordingly, if the number of appearing BONUS symbols is greater, more payout can be attained. Also, if the dividend per bonus symbol added through Step S1919 is higher, more payout can be attained. For these reasons, if the game mode is returned from a free game mode to a roulette game mode and the dividend is added through Step S1919, the dividend can be increased so that higher payout can be attained in the free game mode.

Next, the main CPU 222 determines whether the count of unit games in the free game mode or the count of free games is maximum number of games (Step S2835). If the determination is that the count of unit games in the free game mode or the count of free games is not the maximum number of games, or that the count of unit games in the free game mode is less than the maximum number of games (NO), the main CPU 222 returns to Step S2815. Consequently, the free game mode is continued until the game count reaches the maximum number of games.

If the determination at Step S2835 is that the count of unit games in the free game mode or the count of free games is the maximum number of games (YES), the main CPU 222 exits this subroutine. Consequently, the free game mode ends; the game mode returns to the base game mode.

The free game mode in the present embodiment offer at least seven free games of unit games. Furthermore, the payout is determined based on the number of BONUS symbols appearing in the display window 56. If five or more BONUS symbols appear in the display window 56, the maximum number of games increases; accordingly, more free games of unit games can be offered. Still further, if five or more BONUS symbols appear in the display window 56, the game mode changes to a roulette game mode; the dividend can be increased so that the benefit for the player can be further increased.

What is claimed is:

1. A gaming machine configured to determine a dividend based on rearranged symbols, the gaming machine comprising:

a display having a display area in which symbols associated with a plurality of scroll lines are displayed; and a controller for controlling base games, roulette games, and free games, in which game results are displayed in the display area, the free games being games that require no bet operation by a player, and the controller being programmed to perform the processing of (1-1) to (1-5):

(1-1) in the base games, switching the base games to the roulette games under a condition that a predetermined number or more of trigger symbols are stopped in the display occur;

(1-2) in the roulette games, determining a maximum number of lotteries based on a number of trigger symbols;

(1-3) in each of the roulette games, determining either a dividend in the free games or winning a jackpot by lottery;

(1-4) in each of the roulette games, incrementing a counted number of a conducted lottery by one in a case where the processing of (1-3) determines the dividend in the free games by the lottery;

(1-5) in each of the roulette games, repeating the processing of (1-3) without incrementing the counted number in a case where the processing of (1-3) determines winning the jackpot by the lottery; and (1-6) switching the roulette games to the free games under a condition that the counted number reaches the maximum number of lotteries.

2. The gaming machine according to claim 1, wherein the jackpot is one of a plurality of kinds of jackpots, and wherein the controller is programmed to perform the processing of (2-1):

(2-1) in the roulette games, allowing all the plurality of kinds of jackpots to be won by lotteries.

3. The gaming machine according to claim 1, wherein the dividend in the free games is one of a plurality of kinds of dividends, and wherein the controller is programmed to perform the processing of (3-1):

(3-1) in the roulette games, increasing a probability to win the jackpot depending on a number of kinds of dividends in the free games determined by the lottery.

4. The gaming machine according to claim 1, wherein the lottery includes a first lottery and a second lottery, and wherein the processing of (1-3) includes the processing of (1-3-1) and (1-3-2):

(1-3-1) conducting the first lottery for a jackpot; and (1-3-2) after the processing of (1-3-1), conducting the second lottery for the dividend in the free games.

5. The gaming machine according to claim 2, wherein the lottery includes a first lottery and a second lottery, and wherein the processing of (1-3) includes the processing of (2-3-1) to (2-3-3):

(2-3-1) conducting the first lottery for the jackpot;

(2-3-2) performing the processing of (2-3-1) again in a case of winning any one of the plurality of kinds of jackpots; and (2-3-3) conducting the second lottery for the dividend in free games in a case of losing all of the plurality of kinds of jackpots.

6. The gaming machine according to claim 5, wherein the processing of (2-3-1) includes the processing of (2-3-2-1):

(2-3-2-1) in a case of winning any one or more kinds of jackpots among the plurality of kinds of jackpots, conducting the lottery for the jackpot after excluding the one or more kinds of jackpots already won.

7. The gaming machine according to claim 3, further comprising a memory for storing:

the number of kinds of dividends determined through the processing of (1-3); and a lottery table defining probabilities to win the jackpot in such a manner that the probability to win the jackpot increases as the number of determined kinds of dividends increases, wherein the processing of (3-1) includes the processing of (3-1-1) and (3-1-2):

(3-1-1) retrieving the number of kinds of dividends determined through the processing of (1-3) from the memory; and (3-1-2) conducting the lottery for the jackpot based on the retrieved number of kinds of dividends with reference to the lottery table.

8. The gaming machine according to claim 1, wherein the maximum number of lotteries is proportional to the number of trigger symbols.

* * * * *